US007789145B2

(12) United States Patent
Patel

(10) Patent No.: US 7,789,145 B2
(45) Date of Patent: Sep. 7, 2010

(54) INFLOW CONTROL DEVICE

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 307 days.

(21) Appl. No.: 11/765,932

(22) Filed: Jun. 20, 2007

(65) Prior Publication Data

US 2008/0314590 A1 Dec. 25, 2008

(51) Int. Cl.
*E21B 43/04* (2006.01)

(52) U.S. Cl. ..... 166/278; 166/51; 166/227

(58) Field of Classification Search ..... 166/278, 166/373, 51, 227

See application file for complete search history.

(56) References Cited

U.S. PATENT DOCUMENTS

| | | | |
|---|---|---|---|
| 2,837,032 | A | 6/1958 | Horsting, Sr. |
| 3,323,550 | A | 6/1967 | Lee |
| 4,237,978 | A | 12/1980 | Calderon et al. |
| 4,951,753 | A | 8/1990 | Eriksen |
| 5,269,376 | A | 12/1993 | Gadelle et al. |
| 5,307,984 | A | 5/1994 | Nagaoka et al. |
| 5,355,953 | A | 10/1994 | Shy et al. |
| 5,435,393 | A | 7/1995 | Brekke et al. |
| 5,730,223 | A | 3/1998 | Restarick |
| 5,803,179 | A | 9/1998 | Echols et al. |
| 5,881,809 | A | 3/1999 | Gillespie et al. |
| 5,896,928 | A | 4/1999 | Coon |
| 5,906,238 | A | 5/1999 | Carmody et al. |
| 6,030,332 | A | 2/2000 | Hensley |
| 6,112,815 | A | 9/2000 | Boe et al. |
| 6,112,817 | A | 9/2000 | Voll et al. |
| 6,276,458 | B1 | 8/2001 | Malone et al. |
| 6,289,986 | B1 | 9/2001 | Wright |
| 6,343,651 | B1 | 2/2002 | Bixenman |
| 6,371,210 | B1 | 4/2002 | Bode et al. |
| 6,533,038 | B2 | 3/2003 | Venning et al. |
| 6,622,794 | B2 | 9/2003 | Zisk, Jr. |

(Continued)

FOREIGN PATENT DOCUMENTS

| | | |
|---|---|---|
| EP | 0588421 | 9/1993 |

(Continued)

OTHER PUBLICATIONS

C. Atkinson, et al. "Flow Performance of Horizontal Wells with Inflow Control Devices", European Journal of Applied Mathematics, vol. 15, issue 04, pp. 409-450 (Aug. 2004).

(Continued)

*Primary Examiner*—William P Neuder
(74) *Attorney, Agent, or Firm*—Osha Liang LLP; David G. Matthews; Rodney V. Warfford

(57) ABSTRACT

A system that is usable with a well includes a tubular member and an inflow control device. The screen receives a well fluid flow, and the tubular member has a well fluid communication passageway. The inflow control device changes a momentum of the well fluid flow and/or introduces a flow resistance to regulate a pressure of the well fluid. The number of momentum changes and/or the flow resistance may be changed while the inflow control device is deployed downhole in the well.

33 Claims, 20 Drawing Sheets

U.S. PATENT DOCUMENTS

| | | | | |
|---|---|---|---|---|
| 6,644,412 | B2 | 11/2003 | Bode et al. | |
| 6,672,385 | B2 | 1/2004 | Kilaas et al. | |
| 6,745,843 | B2 | 6/2004 | Johnson et al. | |
| 6,786,285 | B2 | 9/2004 | Johnson et al. | |
| 6,851,560 | B2 | 2/2005 | Reig et al. | |
| 6,857,475 | B2 | 2/2005 | Johnson | |
| 6,857,575 | B2 | 2/2005 | Mathias et al. | |
| 6,883,613 | B2 | 4/2005 | Bode et al. | |
| 6,899,176 | B2 | 5/2005 | Hailey, Jr. et al. | |
| 7,077,200 | B1 | 7/2006 | Adnan | |
| 7,228,912 | B2 | 6/2007 | Patel | |
| 7,413,022 | B2 | 8/2008 | Broome et al. | |
| 7,469,743 | B2 * | 12/2008 | Richards | 166/242.1 |
| 2002/0075110 | A1 | 6/2002 | Shimizu | |
| 2003/0023185 | A1 | 1/2003 | Mertelmeier | |
| 2004/0018839 | A1 | 1/2004 | Andric | |
| 2004/0035591 | A1 | 2/2004 | Echols | |
| 2004/0251020 | A1 | 12/2004 | Smith | |
| 2005/0126776 | A1 | 6/2005 | Russell | |
| 2005/0173130 | A1 | 8/2005 | Richard | |
| 2006/0157257 | A1 | 7/2006 | Ross et al. | |
| 2007/0131434 | A1 | 6/2007 | MacDougal et al. | |
| 2007/0246210 | A1 * | 10/2007 | Richards | 166/56 |
| 2007/0272408 | A1 * | 11/2007 | Zazovsky et al. | 166/278 |
| 2008/0041588 | A1 * | 2/2008 | Richards et al. | 166/265 |

FOREIGN PATENT DOCUMENTS

| | | | |
|---|---|---|---|
| GB | 2376970 | A | 12/2002 |
| WO | 02075110 | | 6/2002 |
| WO | 03023185 | | 3/2003 |
| WO | 03072907 | A1 | 9/2003 |
| WO | 2004018839 | | 3/2004 |
| WO | 2004113671 | | 12/2004 |
| WO | 2005080750 | A1 | 9/2005 |

OTHER PUBLICATIONS

"Equalizertm Production Enhancement System", Baker Oil Tools, Baker Hughes Inc., Pub. No. BOT-04-7761 4M (Jun. 2005).
"Application Answers: Combating Coning by Creating Even Flow Distribution in Horizontal Sand-Control Completions", Weatherford International Ltd. (2005).
Ben J. Dikken, "Pressure Drop in Horizontal Wells and Its Effect on Production Performance", SPE 19824, pp. 1426-1433, pp. 569-574, Society of Petroleum Engineers (Nov. 1990).
M.J. Landman, et al., "Optimization of Perforation Distribution for Horizontal Wells", SPE 23005, pp. 567-576, Society of Petroleum Engineers (1991).
A.N. Folefac, et al., "Effect of Pressure Drop Along Horizontal Wellbores on Well Performance", SPE 23094, pp. 549-560, Society of Petroleum Engineers (1991).
B.P. Marrett, et al., "Optimal Perforation Design for Horizontal Wells in Reservoirs with Boundaries", SPE 25366, pp. 397-406, Society of Petroleum Engineers (1993).
Kristian Brekke, et al., "A New Modular Approach to Comprehensive Simulation of Horizontal Wells", SPE 26518, pp. 109-123, Society of Petroleum Engineers (1993).
Fikri J. Kuchuk, et al., "Performance Evaluation of Horizontal Wells", SPE 39749, pp. 231-243, Society of Petroleum Engineers (1998).
Hong Yuan, et al., "Effect of Completion Geometry and Phasing on Single-Phase Liquid Flow Behavior in Horizontal Wells", SPE 48937, pp. 93-104, Society of Petroleum Engineers (1998).
Yula Tang, et al., "Performance of Horizontal Wells Completed with Slotted Liners and Perforations", SPE 65516, pp. 1-15, Society of Petroleum Engineers/PS-CIM International Conference on Horizontal Well Technology (1991).
Terje Moen, et al., "A New Sand Screen Concept. No Longer the Weakest Link of the Completion String", SPE 68937, pp. 1-10, Society of Petroleum Engineers (2001).
Jody R. Augustine, "An Investigation of the Economic Benefit of Inflow Control Devices on Horizontal Well Completions Using a Reservoir-Wellbore Coupled Model", SPE 78293, pp. 1-10, Society of Petroleum Engineers (2002).
D.S. Qudaihy, et al., "New-Technology Application to Extend the life of Horizontal Wells by Creating Uniform-Flow-Profiles: Production Completion System: Case Study", SPE/IADC 85332, pp. 1-5, Society of Petroleum Engineers/International Association of Drilling Contractors (2003).
K.H. Henriksen, et al., "Integration of New Open Hole Zonal Isolation Technology Contributes to Improved Reserve Recovery and Revision in Industry Best Practices", SPE 97614, pp. 1-6, Society of Petroleum Engineers (2005).
J.C. Moreno, et al., "Optimized Workflow for Designing Complex Wells", SPE 99999, pp. 1-8, Society of Petroleum Engineers (2006).
Sada D. Joshi, Horizontal Well Technology, Chapter 10, "Pressure Drop Through a Horizontal Well", pp. 379-382, 388-396, 404-407, 412-414, PennWell Books, PennWell Publishing Co., Tulsa, OK (1991).
ResFlow,Reslink, http://www.reslink.com/products3.html (2003).
ResFlow: Well Production Management System, Reslink (2005).
Cameron White, et al., "Controlling Flow in Horizontal Wells", World Oil, pp. 73-80 (Nov. 1991).
U.S. Appl. No. 11/643,104, Restriction Requirement mailed on Mar. 5, 2009.
U.S. Appl. No. 11/643,104, Election of Species mailed on Mar. 4, 2009.
U.S. Appl. No. 11/643,104, Office Action mailed on Sep. 2, 2009.
U.S. Appl. No. 11/643,104, Reply to Office Action Mailed Sep. 2, 2009, filed on Jan. 4, 2010.
Office Action dated Apr. 14, 2010 from U.S. Appl. No. 11/643,104 (10 pages).

* cited by examiner

INFLOW CONTROL DEVICE

BACKGROUND

The invention generally relates to an inflow control device.

For purposes of filtering particulates from produced well fluid, a well fluid production system may include sandscreen assemblies, which are located in the various production zones of the well bore. The sandscreen assembly forms an annular barrier around which a filtering substrate of gravel may be packed. The openings in the sandscreen assembly are sized to allow the communication of well fluid into the interior space of the assembly while maintaining the surrounding gravel in place.

Without compensation, the flow distribution along the sandscreen assembly is non-uniform, as the pressure drop across the sandscreen assembly inherently changes along the length of the assembly. An uneven well fluid flow distribution may cause various production problems. Therefore, for purposes of achieving a more uniform flow distribution, the sandscreen assembly typically includes flow control devices, which are disposed along the length of the assembly to modify the fluid flow distribution.

For example, flow control devices called chokes may be disposed along the length of the sandscreen assembly. Each choke has a cross-sectional flow path, which regulates the rate of fluid flow into an associated sandscreen section. The chokes establish different flow restrictions to counteract the inherent non-uniform pressure distribution and thus, ideally establish a more uniform flow distribution long the length of the sandscreen assembly.

Other flow control devices may be used as an alternative to the choke. For example, another type of conventional flow control has a selectable flow resistance. Thus, several such flow control devices, each of which has a different associated flow resistance, may be disposed along the length of the sandscreen assembly for purposes of achieving a more uniform flow distribution.

SUMMARY

In an embodiment of the invention, an apparatus that is usable with a well includes an inflow control device and a mechanism to allow a flow resistance and/or a number of momentum changes experienced by a flow through the inflow control device to be adjusted downhole in the well.

In another embodiment of the invention, a system that is usable with a well includes a tubular member and an inflow control device. The tubular member has a well fluid communication passageway, and the inflow control device introduces at least one momentum change to the well fluid flow to regulate a pressure of the flow.

Advantages and other features of the invention will become apparent from the following drawing, description and claims.

DETAILED DESCRIPTION

Figure 1:
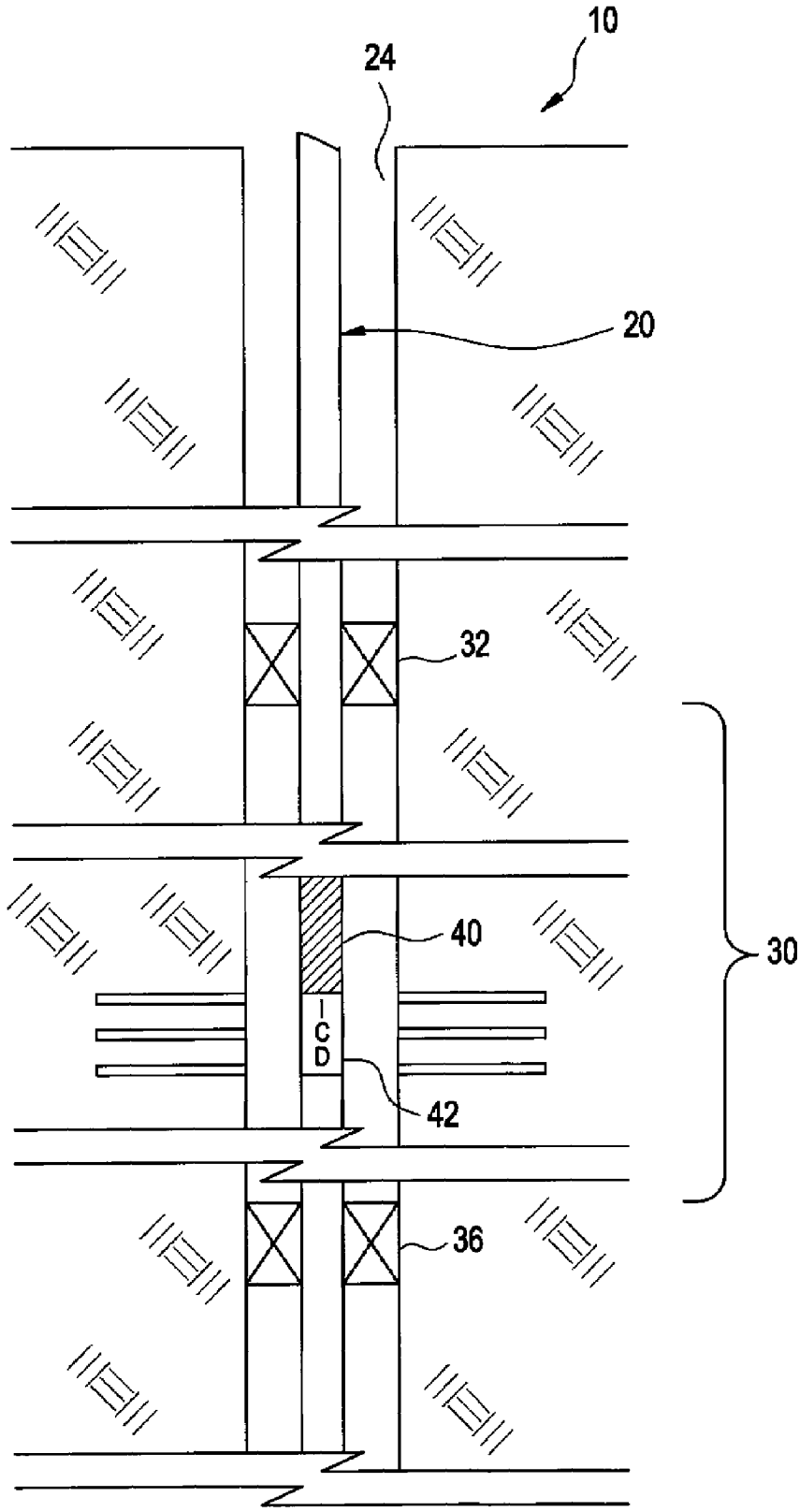
FIG. 1 is a schematic diagram of a well according to an embodiment of the invention.

Referring to FIG. 1, an embodiment 10 of a well (a subsea well or a subterranean well) in accordance with the invention includes a tubular string 20 that is disposed inside a wellbore 24. Although the wellbore 24 is depicted in FIG. 1 as being a vertical wellbore, the wellbore 24 may be a lateral, or horizontal, wellbore in accordance with other embodiments of the invention. As depicted in FIG. 1, the tubular string 20 traverses a particular production zone 30 of the well 10. For purposes of example, the production zone 30 is shown in FIG. 1 as being formed between upper 32 and lower 36 annular isolation packers.

Inside the production zone 30, the tubular string 20 includes a series of connected sandscreen assemblies, each of which includes a sandscreen section 40 and an associated inflow control device 42. It is noted that although one sandscreen section 40 and one inflow control device 42 are depicted in FIG. 1, it is understood that the tubular string 20 and the production zone 30 in particular may include multiple inflow control devices 42 and sandscreen sections 40, in accordance with embodiments of the invention.

In yet another embodiment sand screen may not be required, e.g. in a carbonate formation. Instead of the sand screen assembly, an alternative assembly may include a solid tubular that is run between two inflow control devices. In yet another embodiment of the invention, an assembly may include a slotted or perforated pipe, which may be used in place of screen, as further described below.

As described herein, the inflow control device 42, as it name implies, regulates the flow of well fluid from the annulus that immediately surrounds the associated sandscreen section 40, through the sandscreen section 40 and into the central passageway of the tubular string 20. Thus, the tubular string 20 has multiple inflow control devices 42, each of which is associated with a sandscreen section 40 and has an associated flow characteristic for purposes of establishing a relatively uniform flow distribution from the production zone 30.

In accordance with some embodiments of the invention, the inflow control device 42 may have an adjustable flow resistance and/or an adjustable number of fluid momentum changes (depending on the particular embodiment of the invention) for purposes of controlling the flow through the device 42. Because downhole conditions may change over time and/or the desired flow resistance/number of momentum changes may not be known until the tubular string 20 is installed in the well 10, the inflow control device 42 has the flexibility to address these challenges.

More specifically, in accordance with embodiments of the invention, a tool, such as a shifting tool (as an example), may be lowered downhole from the surface of the well 10 for purposes of engaging the inflow control device 42 to change the device's state. As a more specific example, in accordance with some embodiments of the invention, the inflow control device 42 has at least three states: a first state, herein called a "gravel pack state," in which the inflow control device 42 is fully open for purposes of allowing a maximum flow through the device 42 during a gravel pack operation; a second state, herein called a "choked state," in which the inflow control device 42 restricts the flow for purposes of regulating the flow distribution along the production zone 30; and a third state, called a "closed state," in which the inflow control device 42 blocks all fluid communication and thus, does not communicate any well fluid into the central passageway of the tubular member 20.

The three states that are set forth above are merely examples, as the inflow control device 42 may have more or fewer than three states, depending on the particular embodiment of the invention. For example, in accordance with other embodiments of the invention, the inflow control device 42 may have multiple choked states. For example, for embodiments in which the inflow control device 42 has an adjustable flow resistance, in each of these choked states, the inflow control device 42 may present a different flow resistance. For embodiments of the invention in which the inflow control device 42 has an adjustable number of momentum changes, the inflow control device 42 may have multiple choked positions, each of which establishes a particular number of momentum changes. Thus, many variations are contemplated and are within the scope of the appended claims.

Figure 2:
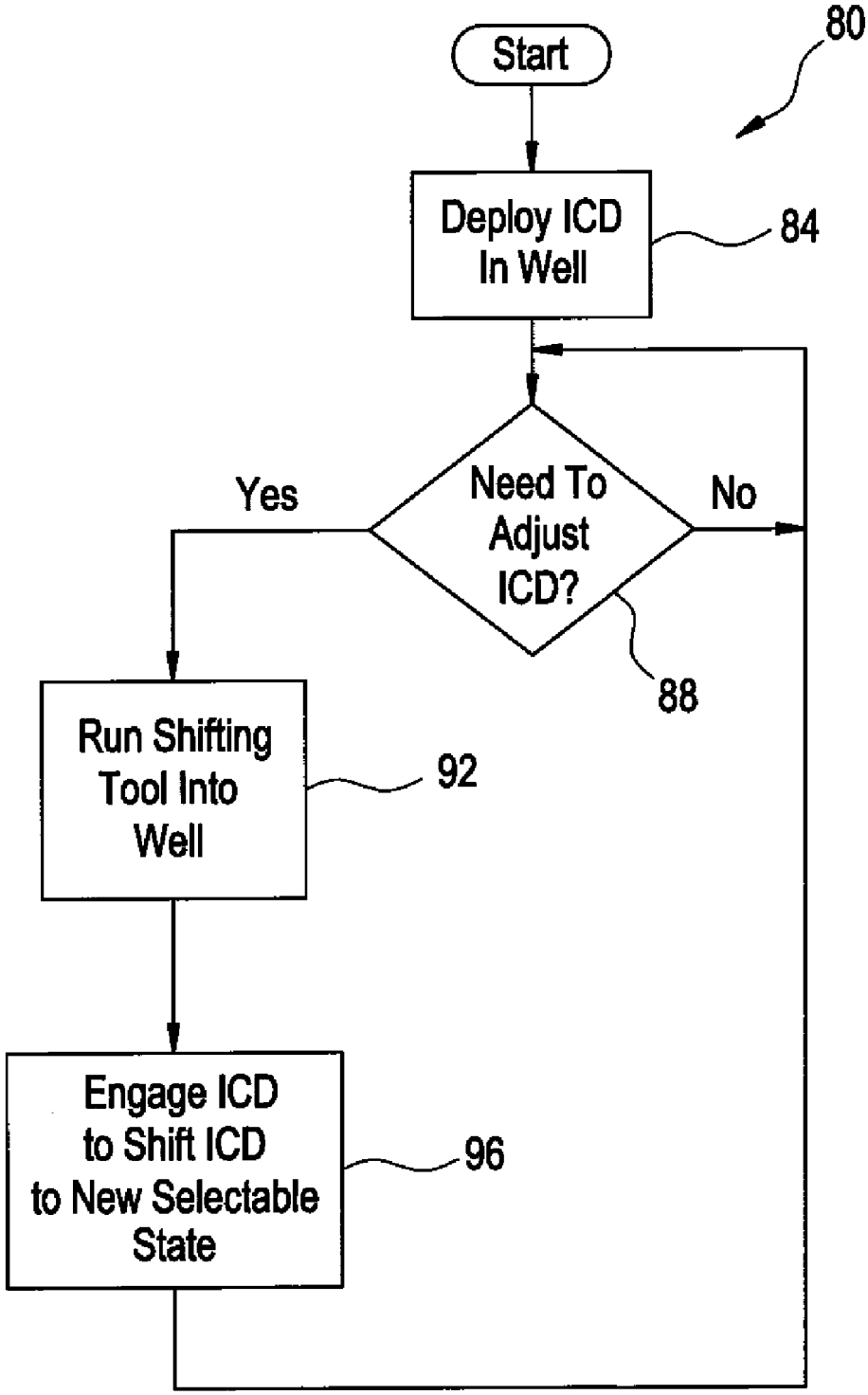
FIG. 2 is a flow diagram depicting a technique to adjust an inflow control device downhole in the well according to an embodiment of the invention.

To summarize, FIG. 2 depicts a technique 80 that may be used in accordance with embodiments of the invention. Pursuant to the technique 80, an inflow control device is deployed in a well, pursuant to block 84. If a determination is made (diamond 88) that an adjustment is made to the state of the inflow control device, then a shifting tool is run into the well, pursuant to block 92. It is noted that the shifting tool is an example of one out of many possible tools that may be used, in accordance with the various embodiments of the invention, to change the inflow control device's state. In general, the shifting tool is a tool that is run inside the inflow control device and engaged with the mandrel of the inflow control device to change the position of the mandrel from one state to another state. The shifting tool may be a mechanical, hydraulic, electric or another variation. Using the shifting tool as an example, the inflow control device is engaged to shift the inflow control device to a new selectable state, pursuant to block 96.

Figure 3:
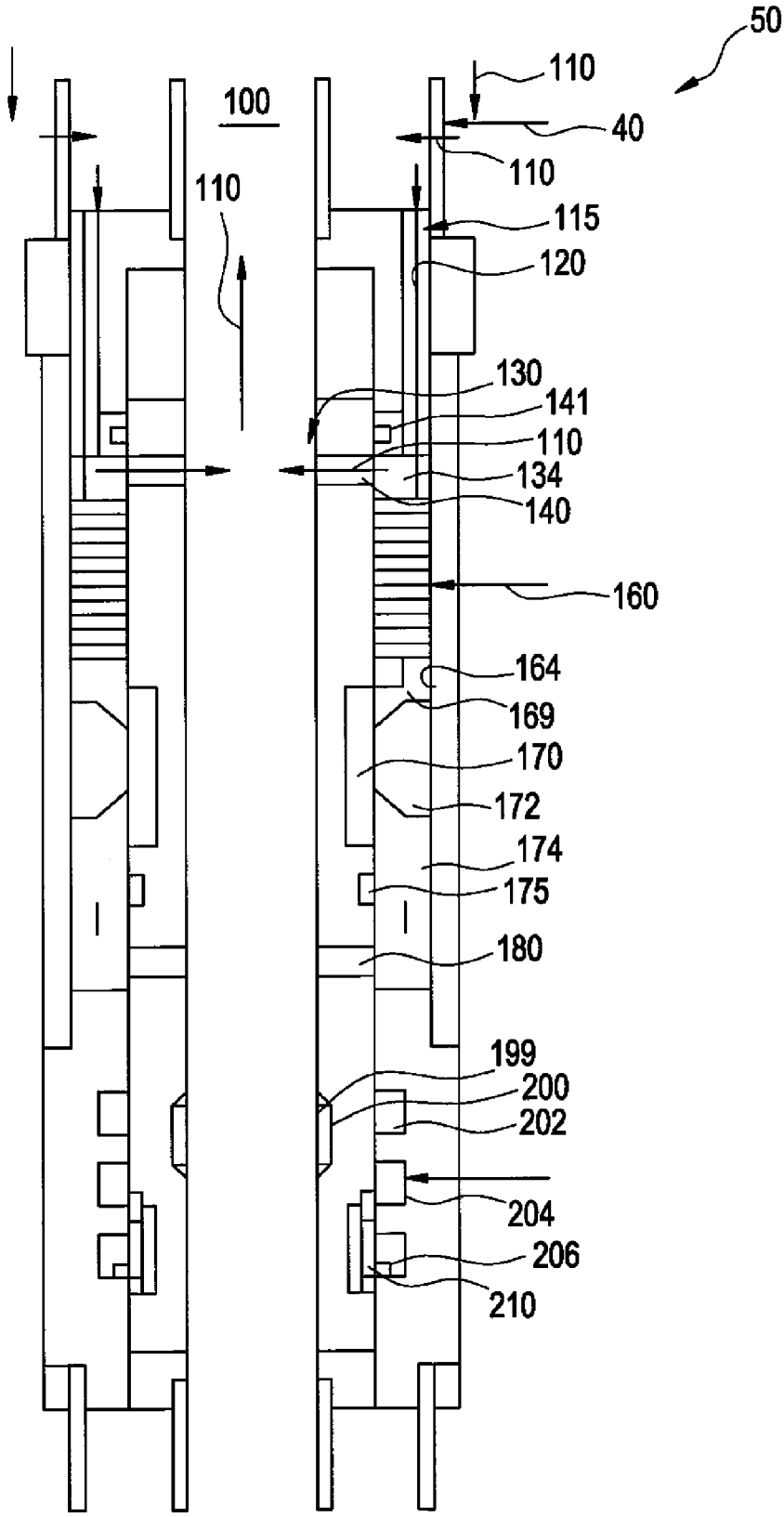
FIGS. 3, 4 and 5 are schematic diagrams depicting different operational states of a spring-type inflow control device according to an embodiment of the invention.
Figure 4:
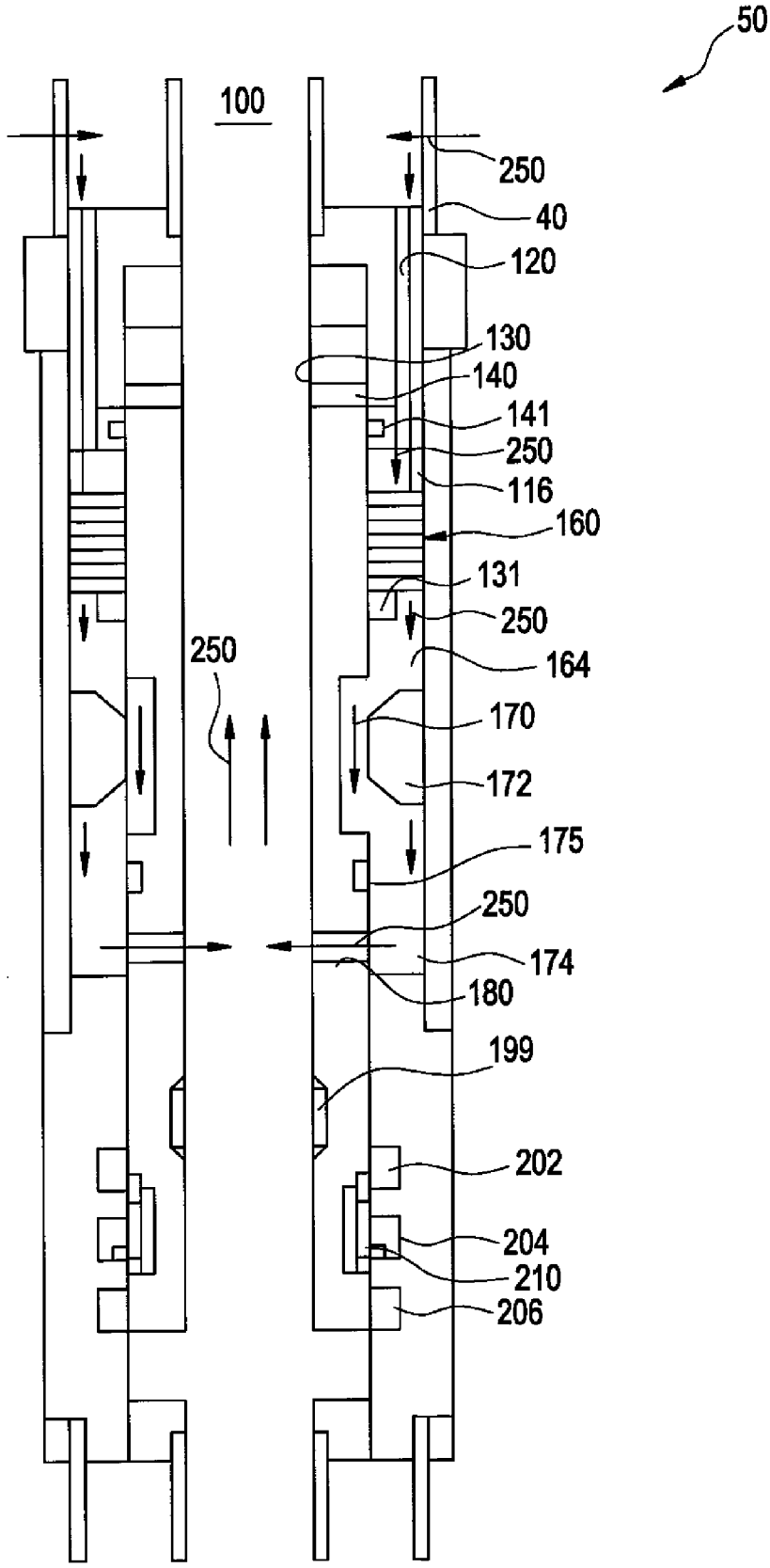
Figure 5:
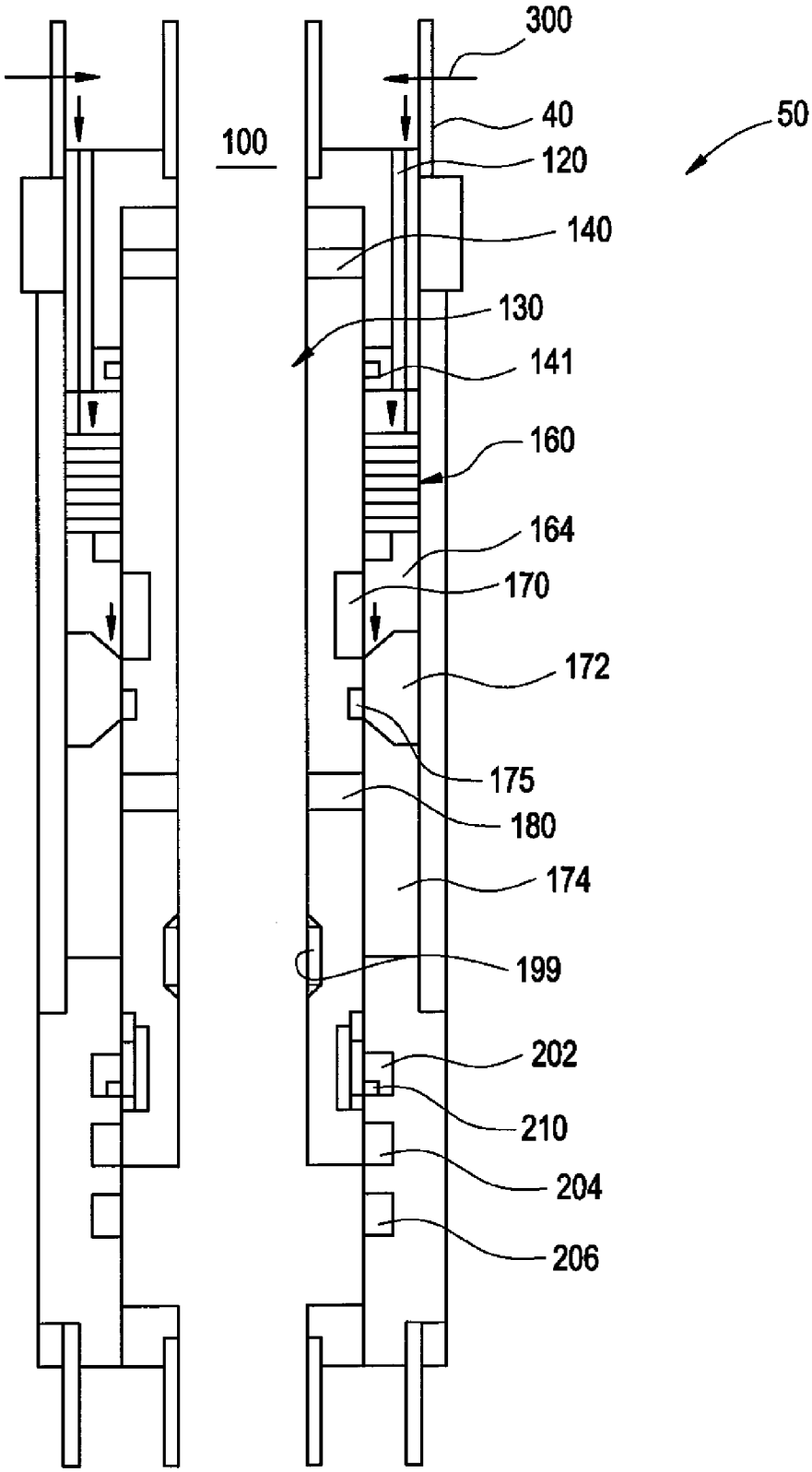

FIGS. 3-5 depict an inflow control device 50 according to an embodiment of the invention, which has an annular, helical flow path that has an adjustable flow resistance. In general, the flow resistance of the inflow control device 50 establishes the pressure differential and flow that are created by the device 50 in its choked state (described below).

The inflow control device 50, in general, may be placed in one of three states downhole in the well: a gravel pack state (FIG. 3) in which the inflow control device 50 has a minimal flow resistance; a choked state (FIG. 4) in which the inflow control device 50 has an increased flow resistance; and a closed state (FIG. 5) in which the inflow control device 50 blocks all flow. It is noted that the three states that are depicted in FIGS. 3-5 and described below are used for purposes of an example of an adjustable inflow control device whose state may be adjusted downhole in a well. Thus, the inflow control device 50 may, in accordance with other embodiments of the invention, have additional states, such as additional choked states, where each of the choked states is associated with a different flow resistance. Thus, many variations are contemplated and are within the scope of the appended claims.

Referring to FIG. 3, in general, the inflow control device 50 includes a tubular housing 115, which may be formed from one or more housing sections. The housing 115 has a central passageway 100 that is concentric with a production tubing to which the inflow control device 50 is connected. The housing 115 contains an annular cavity 164 that houses a coil spring 160 that is concentric with the longitudinal axis of the inflow control device 50. The coil spring 160 forms an annular helical, or spiral, flow path through which fluid is communicated through the inflow control device 50 in its choked state (see FIG. 4) and has a flow resistance that may be adjusted based on the compression of the spring 160. The use of a coil spring to establish an annular flow path that has an adjustable flow resistance is further described in U.S. patent application Ser. No. 11/643,104, entitled "FLOW CONTROL USING A TORTUOUS PATH," which was filed on Dec. 21, 2006, and is hereby incorporated by reference in its entirety.

In addition to the annular cavity 164, which houses the coil spring 160, the housing 115 includes longitudinal passageways 120 for purposes of communicating well fluid from the associated screen section 40; an annular cavity 134, which is located upstream of the coil spring 160 and is in fluid communication with the screen section 40; a radial restriction 172, which has a variable cross-sectional flow path (as described below) and is located downstream of the coil spring 160; and an annular cavity 174, which is located downstream of the radial restriction 172.

The housing 115 also includes an inner collet profile, which is engaged by a collet latch 210 of an inner mandrel 130 (further described below) for purposes of establishing the particular state of the inflow control device 50. The collet profile includes at least three sets of annular notches, which may be engaged from inside the central passageway 100: a lower set 206 of annular notches for purposes of placing the inflow control device 50 in the gravel pack state (as depicted in FIG. 3); a middle set of annular notches 204 for purposes of placing the inflow control device 50 in the choked state (FIG. 4); and an upper set of annular notches 202 for purposes of placing the inflow control device 50 in the closed state (FIG. 5).

The particular state in which the inflow control device 50 is placed depends on the position of the inner mandrel 130. In general, the mandrel 130 is concentric with the longitudinal axis of the inflow control device 50 and has a central passageway, which forms the corresponding central passageway 100 of the device 50.

In accordance with some embodiments of the invention, the mandrel 130 has a first set of radial bypass ports 140, which are generally aligned with the annular cavity 134 when the inflow control device 50 is in the gravel pack state, as depicted in FIG. 3. A fluid seal is formed between the mandrel 130 and a region of the housing 115 above the annular cavity 134 by an o-ring 141. It is noted that the o-ring 141 may reside, for example, in an annular groove that is formed in the inner surface of the housing 115. Thus, when the inflow control device 50 is placed in the gravel pack state, as depicted in FIG. 3, a fluid flow 110 from the associated screen section 40, in general, bypasses the coil spring 160 and flows into the central passageway 100 via the set of radial bypass ports 140.

In addition to the set of bypass ports 140, the mandrel 130 also includes a set of radial ports 180, which is located below the coil spring 160. As depicted in FIG. 3, in the gravel pack state of the inflow control device 50, the set of radial ports 180 is aligned with the annular cavity 174 to establish another set of fluid communication paths into the central passageway 100. The set of radial ports 180 become the primary communication paths for the inflow control device 50 when the device 50 is placed in the choked state, as depicted in FIG. 4.

Still referring to FIG. 3, for purposes of transitioning the inflow control device 50 from the gravel pack state into the choked state, a shifting tool may be run inside the central passageway 100 to engage a profile 199 located on the inner surface of the mandrel 130. With the shifting tool engaging the profile 199, the shifting tool may be moved upwardly to cause the collet latch 210 to disengage from the lower set of annular notches 206 such that the mandrel 130 moves upwardly to a position at which the collet latch 210 engages the middle set of annular notches 204. At this position of the mandrel 130, the inflow control device 50 is in the choked state. The notches 206, the collet 210, and profile 199 is one method of engaging the shifting tool with mandrel 130 and positioning the mandrel 130 in various positions. The same can be achieved with other means, in accordance with other embodiments of the invention.

Referring to FIG. 4, in the choked state, fluid communication through the set of bypass ports 140 is closed off, to thereby direct all fluid flow (represented by a flow 250 in FIG. 4) through the coil spring 160. In this state, the coil spring 160 has been compressed between an outer annular shoulder 131 of the mandrel 130 and an inner annular shoulder 116 of the housing 115. For embodiments of the invention in which the inflow control device has multiple choked positions (and thus, one or more intermediate sets of annular notches between the notches 202 and 206), the flow resistance of the coil spring 160 may be adjusted by adjusting the distance between the annular shoulders 131 and 116 (as set by the position of the mandrel 130).

In the choked state, all fluid flow is directed through the coil spring 160, as all fluid communication through the upper set of radial bypass ports 140 is closed off. Thus, fluid flows through the coil spring 160, through the annular cavity 164 and into an annular cavity formed between an outer annular cavity 170 of the mandrel 130 and the radial flow restriction 172 of the housing 115. It is noted that in accordance with other embodiments of the invention, for multiple choked states, the relative position between the annular cavity 170 and the radial restriction 172 may be changed to adjust the flow restriction imposed by these components. In the choked state, the fluid flow flows from the annular cavity 170 into the annular cavity 174 and exits into the central passageway 100 via the lower set of radial ports 180.

Referring to FIG. 5, in its closed state, the inflow control device 50 blocks all fluid communication between the associated screen section 40 and the central passageway 100. In this state, the mandrel 130 is in its upper position in which the collet latch 210 engages the upper set of annular notches 202. In the upper position, seals between the mandrel 130 and the housing 115 block communication through the radial ports 140 and 180. Thus, the inflow control device 50 blocks communication of an otherwise flow 300 through the device 50. More specifically, the o-ring 141 seals off communication from occurring through the upper set of bypass ports 140; and a lower annular seal, which may be formed, for example, by an o-ring 175 seals off communication through the lower set of radial ports 180. In accordance with some embodiments of the invention, the o-ring 175 may be located in an annular groove in the outer surface of the mandrel 130.

For simplicity, the figures depict the sets 202, 204 and 206 of annular notches as being uniformly spaced apart. However, it is understood that spacing between the different sets of annular notches may vary as needed (as thus, a uniform spacing may not exist) to properly position the mandrel to establish the different states of the inflow control device 50 and the states of the other inflow control devices that are described below.

Figure 4A:
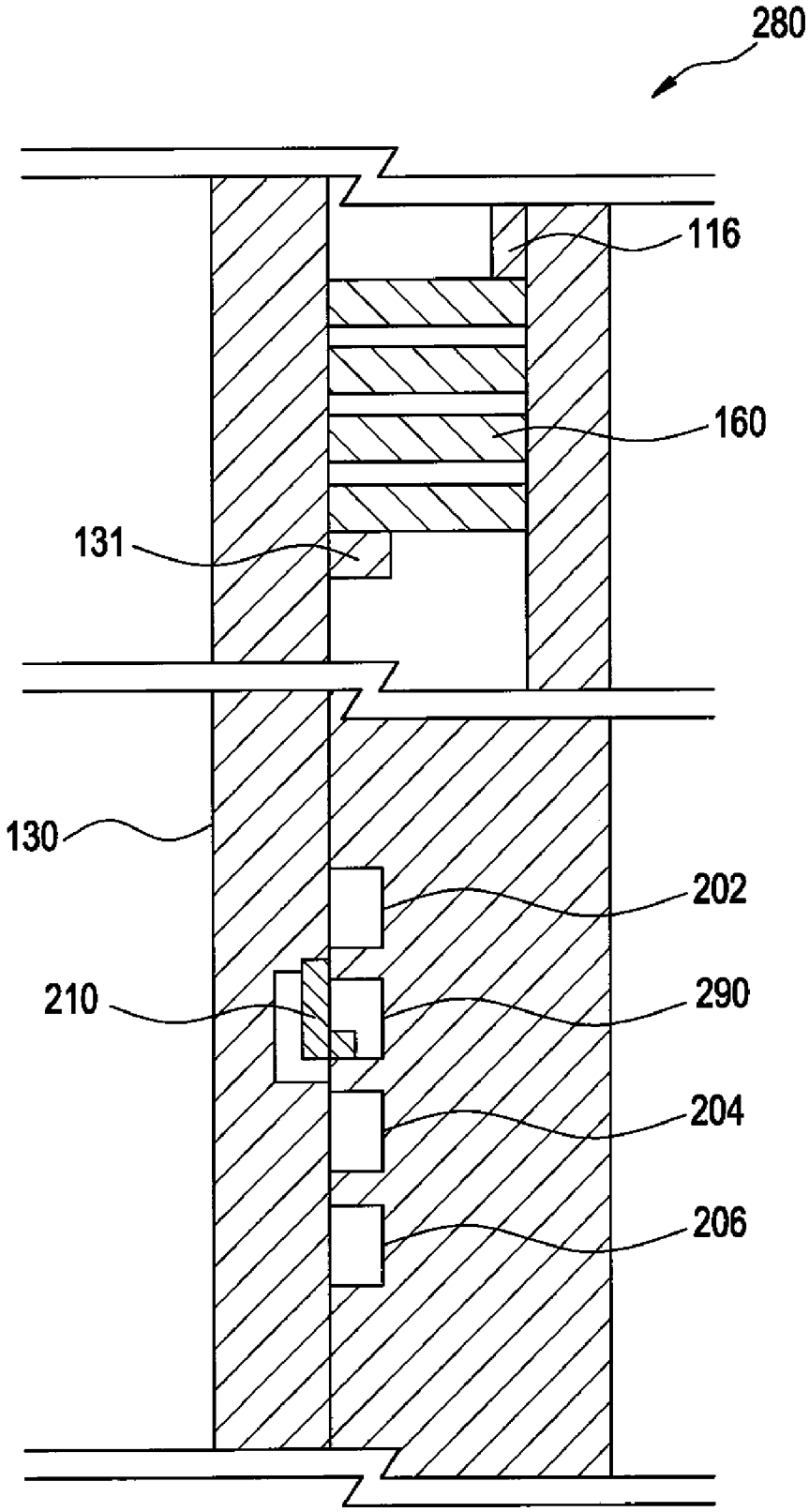
FIG. 4A is a schematic diagram depicting a second choke state of a spring-type inflow control device according to an embodiment of the invention.

Referring to FIG. 4A, in accordance with other embodiments of the invention, the inflow control device 50 may be replaced by a resistance-type inflow control device 280 that has two selectable choked positions. The inflow control device 280 has a similar design to the inflow control device 50, with the differences being depicted in a partial schematic diagram in FIG. 4A, which shows the relevant portion of the device 280 on the right hand side of the longitudinal axis.

Unlike the inflow control device 50, the inflow control device 280 has an extra set of annular notches 290 for purposes of establishing another selectable choke position. A shifting tool may be used to engage and move the mandrel 130 such that the collet latch 210 engages the notches 290 (FIG. 4A). For this position of the mandrel 130, the inflow control device 280 is in a second choke state, in which the coil spring 160 has been compressed more than in the first choke state of the device 280, which is similar to the choke state depicted in FIG. 4. Thus, the inflow control device 280 has two selectable choke states: a first choke state that has a first flow resistance and a second choke state that has a higher, second flow resistance. The inflow control device 280 may have more than two choke states (and thus, more sets of annular notches), in accordance with other embodiments of the invention.

The inflow control device 50, 280 may be replaced by an inflow control device that has a selectable number of fluid momentum changes, instead of a selectable flow resistance. In general, the momentum changes that occur in such an inflow control device play a significant role in the pressure differential and flow that are created by the device in its choked state (described below).

Figure 6:
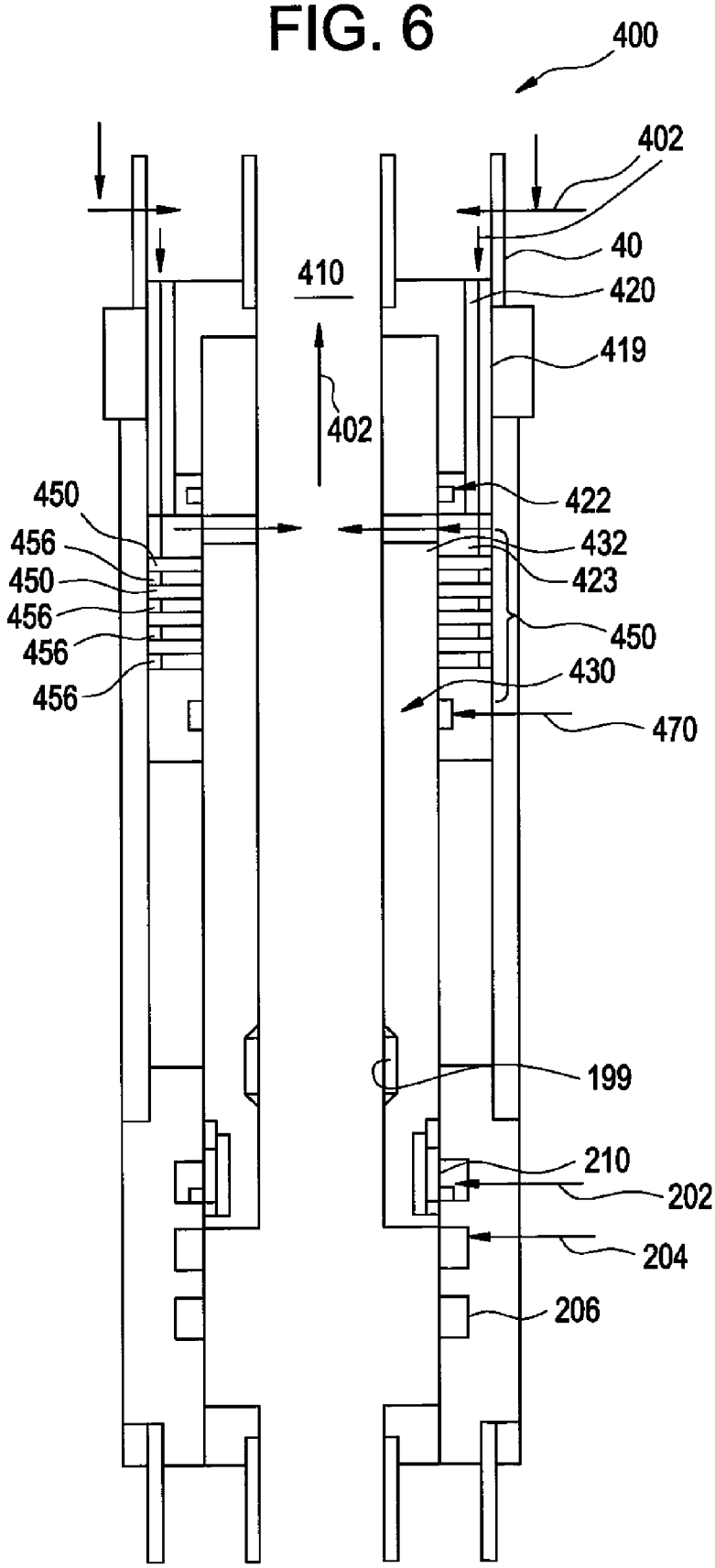
FIGS. 6, 7 and 8 are schematic diagrams depicting different operational states of a spinner flow disc-type inflow control device according to an embodiment of the invention.
Figure 7:
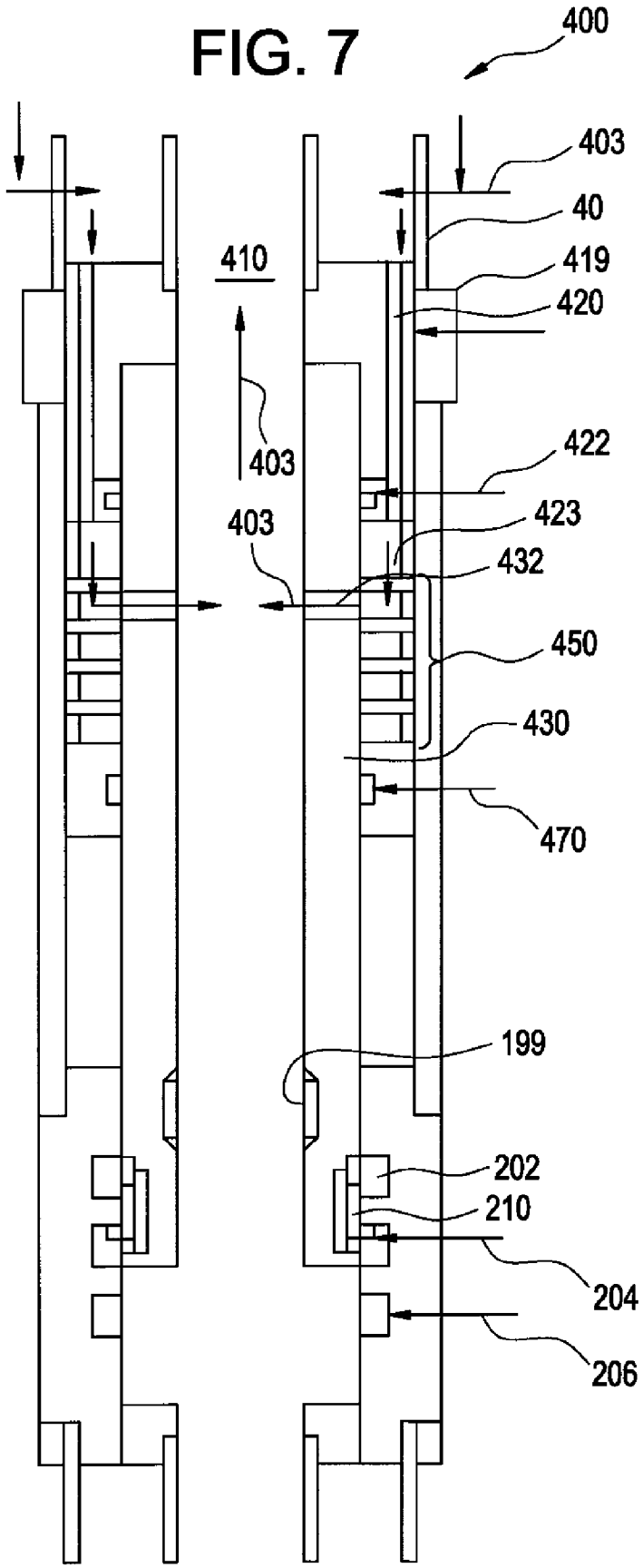
Figure 8:
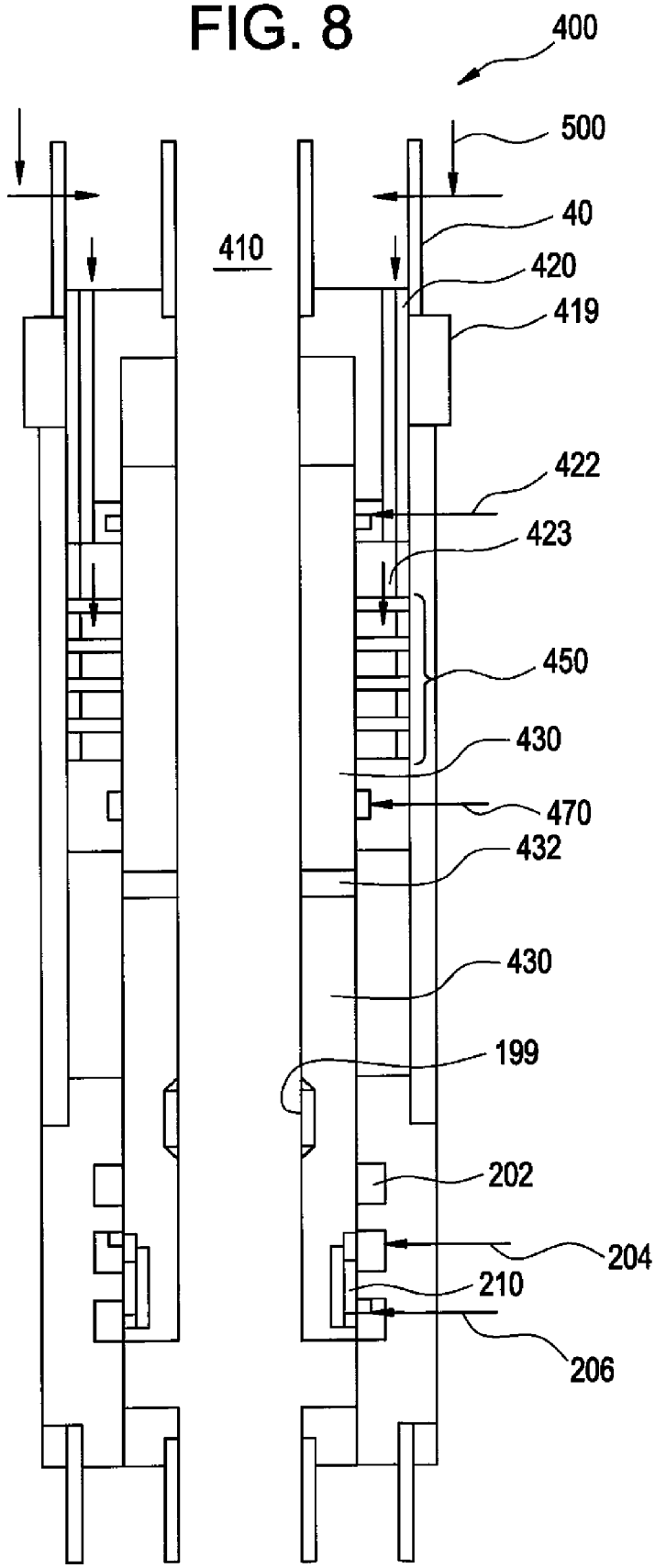

As a specific example, FIGS. 6-8 depict an exemplary momentum changing inflow control device 400 in accordance with some embodiments of the invention. Similar to the inflow control device 50, the inflow control device 400 has at least three states: a gravel pack state (FIG. 6); a choked state (FIG. 7); and a closed state (FIG. 8).

Referring to FIG. 6, in general, the inflow control device 400 includes a tubular housing 419 (formed from one or more sections) that has a central passageway 410 and an inner mandrel 430. The housing 419 includes longitudinal passageways 420 for purposes of communicating well fluid from the associated screen section 40. Depending on the particular state of the inflow control device 400, fluid flow from the screen section 40 to the central passageway 410 may be blocked (for the closed state); may be directed through a set of momentum-changing spinner flow discs 450 (for the choked state); or may be directed directly to the central passageway 410 without passing through the set of spinner flow discs 450 (for the gravel pack state).

Similar to the inflow control device 50, the inflow control device 400 may be actuated by a shifting tool (as an example) for purposes of changing the device's state. In this regard, the inflow control device 400 includes several features similar to the inflow control device 50, such as the following, for purposes of latching the device 400 in one of its states: the inner profile 199; the collet latch 210; and the sets 202, 204 and 206 of annular notches. One difference for the inflow control device 400 is that the mandrel 430 is shifted in the opposite direction to effect the change in states: the upper position (depicted in FIG. 6) is the position in which the inflow control device 400 is in the gravel pack state; the middle position of the mandrel 430 places the inflow control device 400 in the choked state; and the lower position of the mandrel 430 places the inflow control device 400 in the closed state.

Thus, in the upper position of the mandrel 430, depicted in FIG. 6, the inflow control device 400 is in the gravel pack state. In this state, a fluid flow 402 is communicated from the region surrounding the associated screen section 40, into the screen section 40, through the longitudinal passageways 419 and through radial ports 432, which are formed in the mandrel 430. In this state of the inflow control device 400, no fluid flow flows through the set of flow discs 450. It is noted that in accordance with embodiments of the invention, the inflow control device 400 includes a seal that is formed between the housing 410 and the mandrel 430, such as an o-ring 422 that resides in an inner annular groove of the housing 419. Furthermore, another fluid seal exists below a chamber 423 of the housing 419, which houses the set of flow discs 450. The seal may be formed, for example, from an o-ring 470, which was formed in an annular groove in the interior surface of the housing 419.

When the mandrel 430 is shifted to its intermediate position (i.e., the choked state) that is depicted in FIG. 7, the radial ports 432 are positioned below the seal formed by the o-ring 422 and are positioned to receive a flow from at least some of the flow discs 450. Thus, a fluid flow 403 flows into the screen section 40, through the longitudinal passageways 420, through at least part of the flow discs 450, through the radial ports 432 and into the central passageway 410.

In accordance with some embodiments of the invention, the number of spinner flow discs 450, as well as the spacing between the flow discs may be selected, in accordance with some embodiments of the invention, before the inflow control device 400 is deployed in the well for purposes of selecting the flow resistance and number of momentum changes that are introduced by the device 400. However, in accordance with other embodiments of the invention, the effective number of spinner flow discs 450 for the flow (and thus, the number of momentum changes) may be adjusted by the position of the mandrel 430 (and thus, the position of the radial ports 432). Therefore, although FIGS. 5-7 depict only one choked state for the inflow control device 400, the mandrel 430 may have multiple positions at which different parts of the set of spinner flow discs 450 are selected to create different choke states, in accordance with other embodiments of the invention.

In general, the flow discs 450 are arranged to serially communicate a fluid flow, with each flow disc 450 imparting an associated momentum to the fluid that is communicated through the disc 450. Each flow disc 450 is annular in nature, in that the center of the flow disc 450 accommodates the central passageway 410. The momentum of the fluid flow changes each time the flow leaves one flow disc 450 and enters the next. For example, the fluid may flow in a clockwise direction in one spinner flow disc, flow in a counterclockwise direction in the next flow disc 450, flow in a clockwise direction in the next flow disc 450, etc. Spacers 456 between the flow discs 450 are selected based on such factors as the total number of desired momentum changes, flow resistance, etc.

Referring to FIG. 8, for the lowest position of the mandrel 430, the inflow control device 400 is in a closed state, a state in which no fluid is communicated through this associated screen section 40 into the central passageway 410 of the device 400. Thus, the inflow control device 400 blocks communication of an otherwise flow 500. For this state of the inflow control device 400, the radial ports 432 of the inner mandrel 430 are located below both o-rings 422 and 470.

Figure 7A:
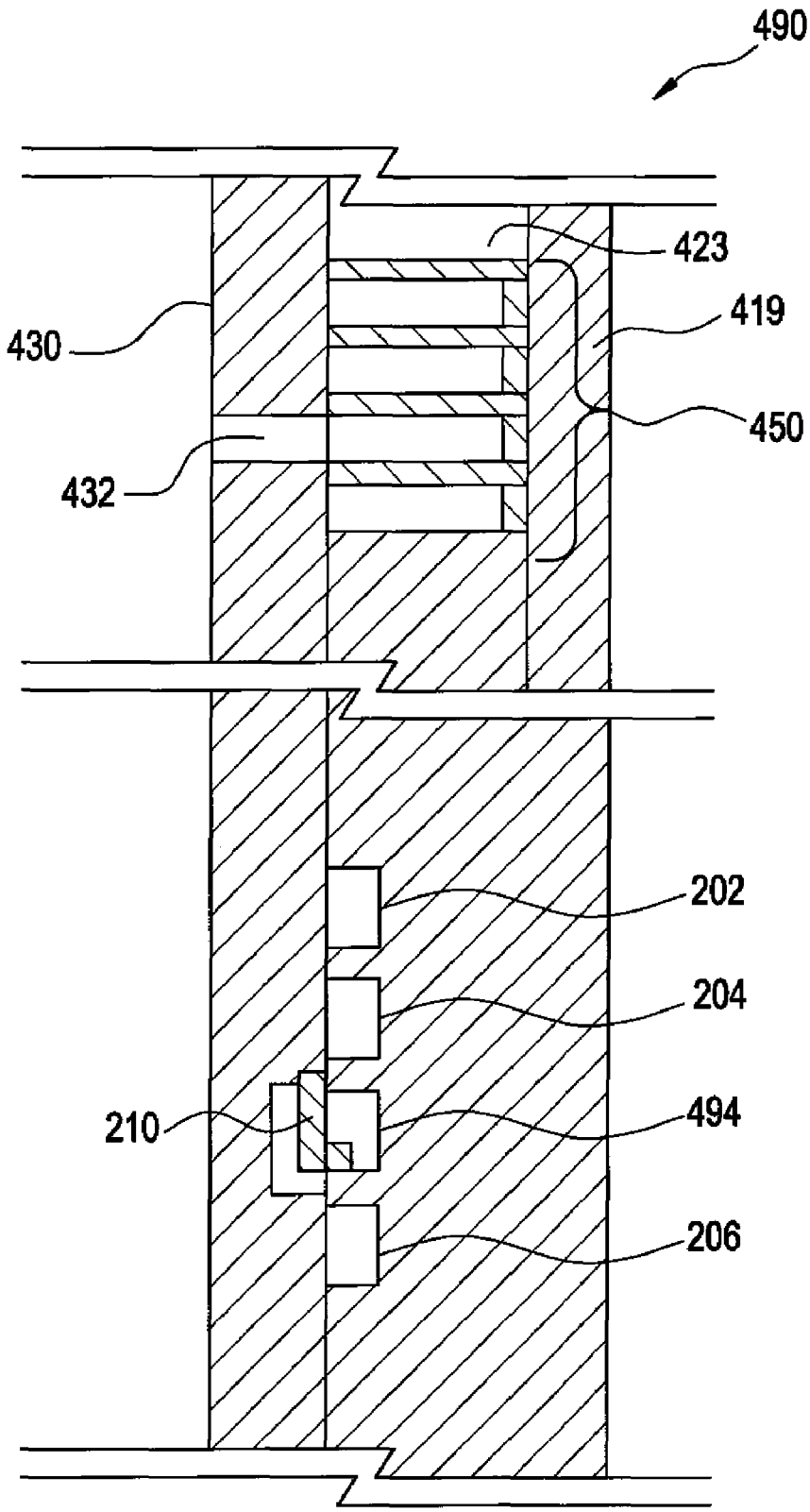
FIG. 7A is a schematic diagram depicting a second choke state of a spinner flow disc-type inflow control device according to an embodiment of the invention

Referring to FIG. 7A, in accordance with other embodiments of the invention, the inflow control device 400 may be replaced by a spinner flow disc-type inflow control device 490 that has two selectable choked positions. The inflow control device 490 has a similar design to the inflow control device 400, with the differences being depicted in a partial schematic diagram in FIG. 7A, which shows the relevant portion of the device 490 on the right hand side of the longitudinal axis.

Unlike the inflow control device 400, the inflow control device 490 has an extra set of annular notches 494 for purposes of establishing another selectable choke position for the mandrel 430 and thus, another choke state. A shifting tool may be used to engage and move the mandrel 430 such that the collet latch 210 engages the notches 494 (as depicted in FIG. 7A). For this position of the mandrel 430, the inflow control device 490 is in a second choke state, in which the radial ports 432 are moved farther down the flow discs 450 such that the flow is communicated through fewer of the flow discs 450. Thus, the inflow control device 490 has two selectable choke states: a first choke state, such as the one that is depicted in FIG. 7 in which the flow experiences a first number of momentum changes and a second choke state, such as the one that is depicted in FIG. 7A in which the flow experiences a lower, second number of momentum changes. The inflow control device 490 may have more than two choke states (and thus, more sets of annular notches), in accordance with other embodiments of the invention.

Figure 9:
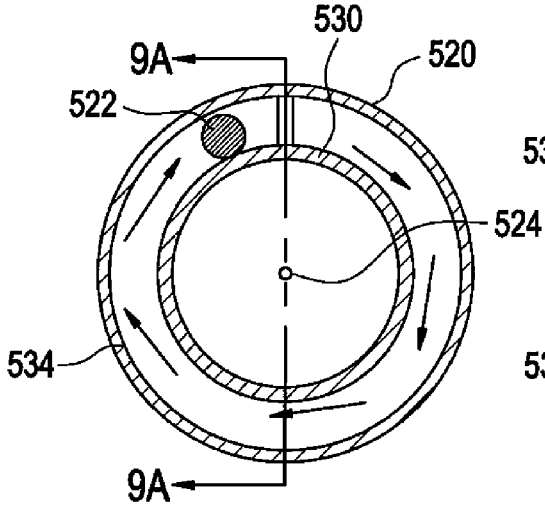
FIGS. 9, 10 and 11 depict top views of spinner flow discs having single flow chambers according to an embodiment of the invention.
Figure 9A:
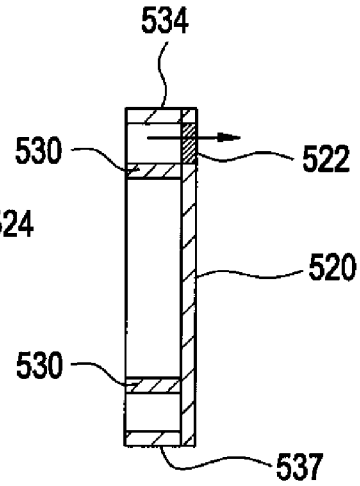
FIG. 9A is a cross-sectional view taken along line 9A-9A of FIG. 9 according to an embodiment of the invention.
Figure 10:
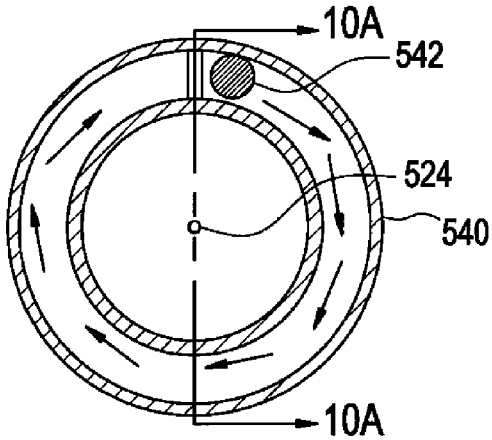
Figure 10A:
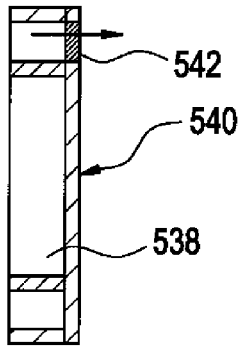
FIG. 10A is a cross-sectional view taken along line 10A-10A of FIG. 10 according to an embodiment of the invention.
Figure 11:
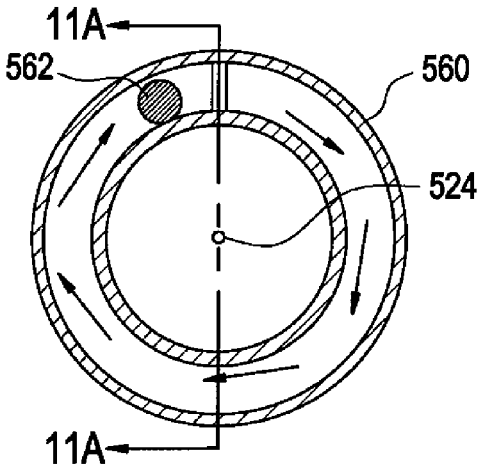
Figure 11A:
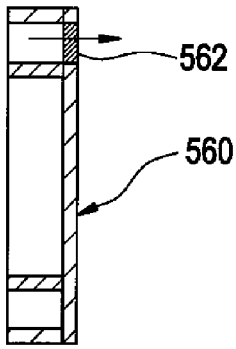
FIG. 11A is a cross-sectional view taken along line 11A-11A of FIG. 11 according to an embodiment of the invention.

FIGS. 9, 10 and 11 depict exemplary spinner flow discs 520, 540 and 560, respectively, in accordance with some embodiments of the invention. In this regard, the spinner flow discs 520, 540 and 560 may be stacked on top of each other for purposes of establishing the set of spinner discs of the inflow control device 400, for example. FIGS. 9A, 10A and 11A depict cross-sectional views of FIGS. 9, 10 and 11, respectively. With the stacking of the spinner flow discs 520, 540 and 560, the spinner flow disc 520 is assumed herein to be the top disc, the spinner flow disc 540; assumed to be the middle flow disc and the spinner flow disc 560 is assumed to be the bottom disc.

Each spinner flow disc 520, 540 and 560 circulates fluid flow around a longitudinal axis 524 in an annular path. The upper flow disc 520 circulates the fluid from an inlet to an outlet 522 in a clockwise direction. The flow from the outlet 522 of the spinner flow disc 520 enters the chamber created by the spinner flow disc 540 to flow in a counterclockwise direction to an outlet 542 of the disc 540. From the disc 540, the fluid once again changes its momentum by flowing into the chamber formed from the spinner flow disc 560 to circulate in a clockwise direction to an outlet 562 of the disc 560.

It is noted that the chambers created by each flow disc are established by a particular plate and the corresponding spacer that forms the walls of the chamber. For example, referring to FIG. 10, the chamber for the flow disc 540 is formed by an inner annular spacer 530 and an outer annular spacer 534.

Figure 12:
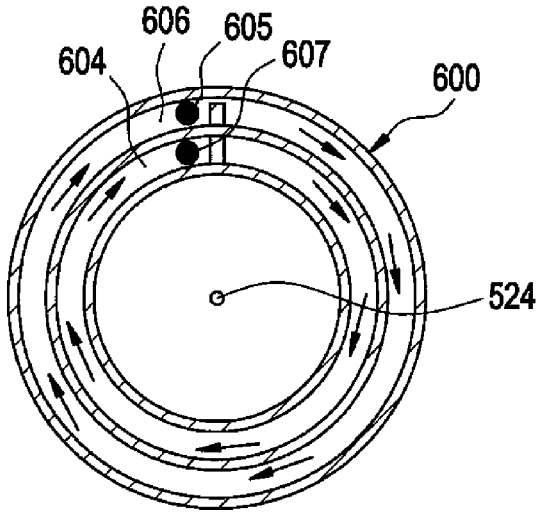
FIGS. 12, 13 and 14 depict spinner flow discs having multiple flow chambers according to an embodiment of the invention.
Figure 13:
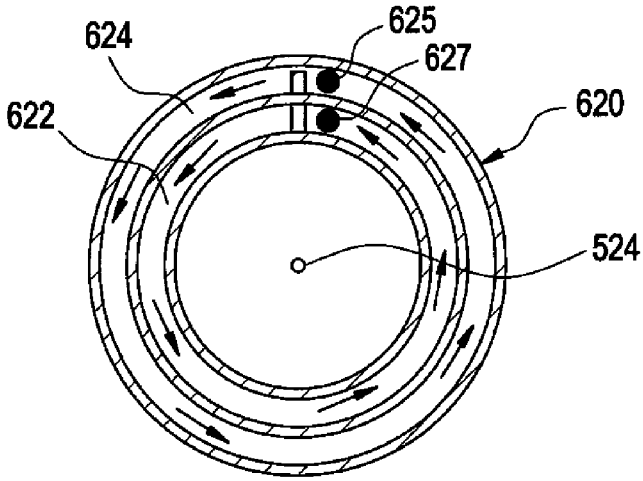
Figure 14:
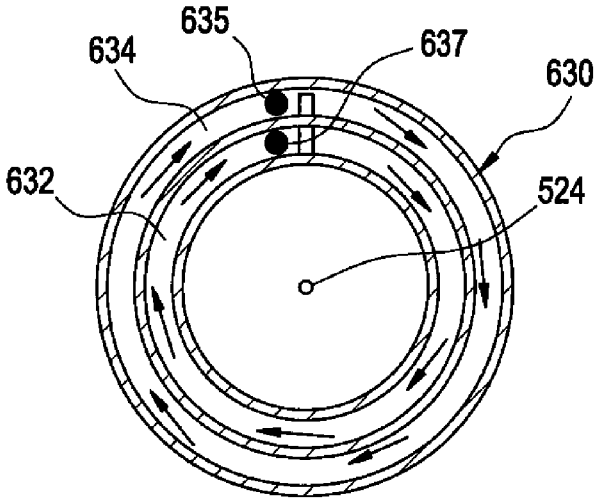

It is noted that although FIGS. 9-11 depict a single flow channel spinner flow disc, the spinner flow disc may establish multiple annular flow chambers in accordance with other embodiments of the invention. For example, FIGS. 12, 13 and 14 depict exemplary spinner flow discs 600, 620 and 630, which may be stacked in a top-to-bottom fashion. Unlike the spinner flow discs 520, 540 and 560 in FIGS. 9-11, the spinner flow discs 600, 620 and 630 each have multiple annular flow chambers. In this regard, the top spinner flow disc 600 has, as an example, two annular flow chambers 604 and 606, each of which is associated with a different flow channel. Thus, as depicted in FIG. 12, the flows circulate independently through the annular chambers 604 and 606 to corresponding exit ports 605 and 607 where the flows enter annular chambers 622 and 624, respectively, of the intermediate spinner flow disc 620 (FIG. 13). In the chambers 622 and 624, the flows independently circulate in a counterclockwise direction to exit ports 627 and 625, respectively. Referring to FIG. 14 upon leaving the flow chamber 622 and 624, the flows then flow chambers 632 and 634, respectively, of the bottom spinner flow disc 630, where the flows circulate in a clockwise direction to exit ports 637 and 635, respectively.

A particular advantage of having multiple annular flow chambers is that this arrangement reduces friction losses and accommodates blockage in one of the flow chambers. Other advantages are possible in accordance with the many different embodiments of the invention.

Figure 15:
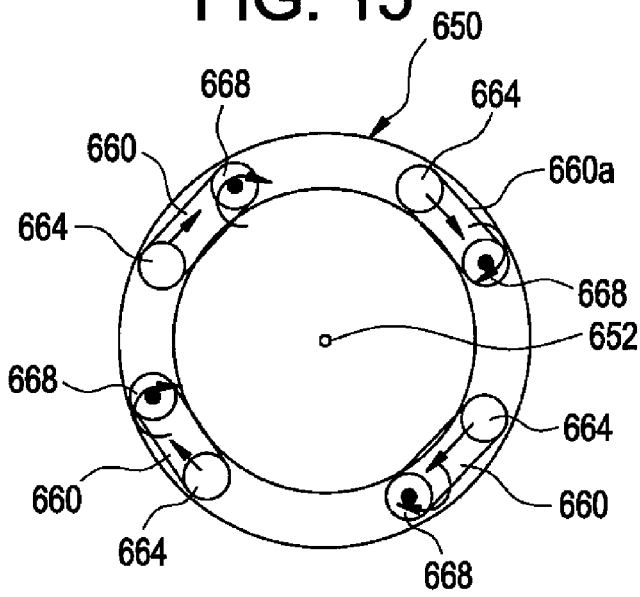
FIGS. 15, 16 and 17 depict spinner flow discs having multiple flow chambers according to another embodiment of the invention.
Figure 16:
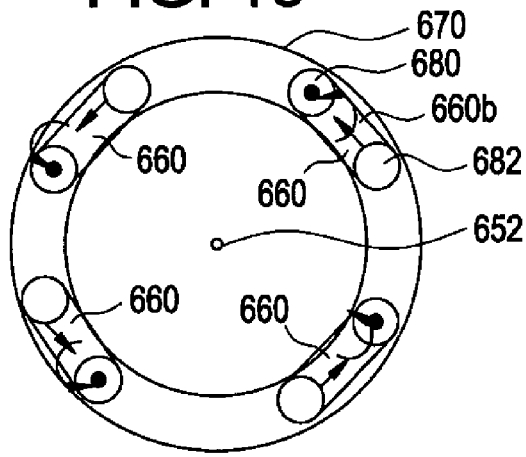
Figure 17:
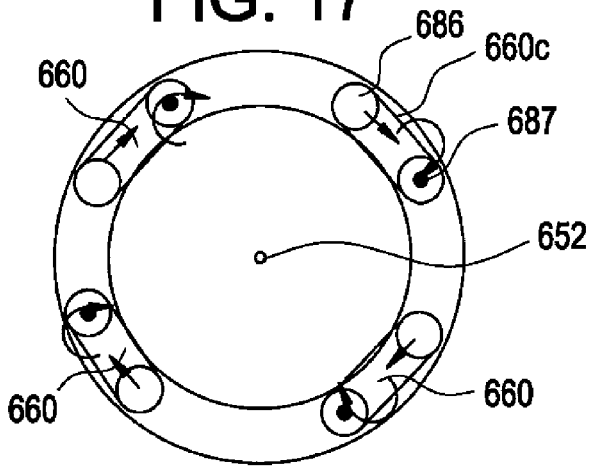

In another variation, FIGS. 15, 16 and 17 depict spinner flow discs 650, 670 and 690, each of which establishes multiple flow chambers. However, unlike the spinner flow discs 600, 620 and 630 of FIGS. 12-14, chambers 660 in each of the spinner flow discs 650, 670 and 690 extends only around a small portion of the entire perimeter of the flow disc.

As a more specific example, the spinner flow discs 650, 670 and 690 may be stacked in a top-to-bottom fashion in which the spinner flow discs 650, 670 and 690 form the top, intermediate and bottom flow discs, respectively. Referring to FIG. 14, as a more specific example, a flow chamber 660*a* is located in the top spinner flow disc 650 and includes an incoming port 664, which receives incoming well fluid. The incoming well fluid circulates around the annular chamber 660*a* and leaves the chamber 660*a* at an exit port 668, where the fluid flows into a corresponding entrance port 682 of a corresponding chamber 660*b* of the middle spinner flow disc 670. The momentum of the fluid is reversed in the chamber 660*b*, and the fluid leaves the chamber 660*b* at an exit port 680. From the exit port 680, the fluid enters a corresponding chamber 660*c* of the spinner flow disc 690. In this regard, the fluid enters an incoming port 686 of the chamber 660*c* of the spinner flow disc 690, where the momentum of the fluid is reversed. The fluid exits the chamber 660*c* at an exit port 687 of the chamber 660*c*.

Figure 18:
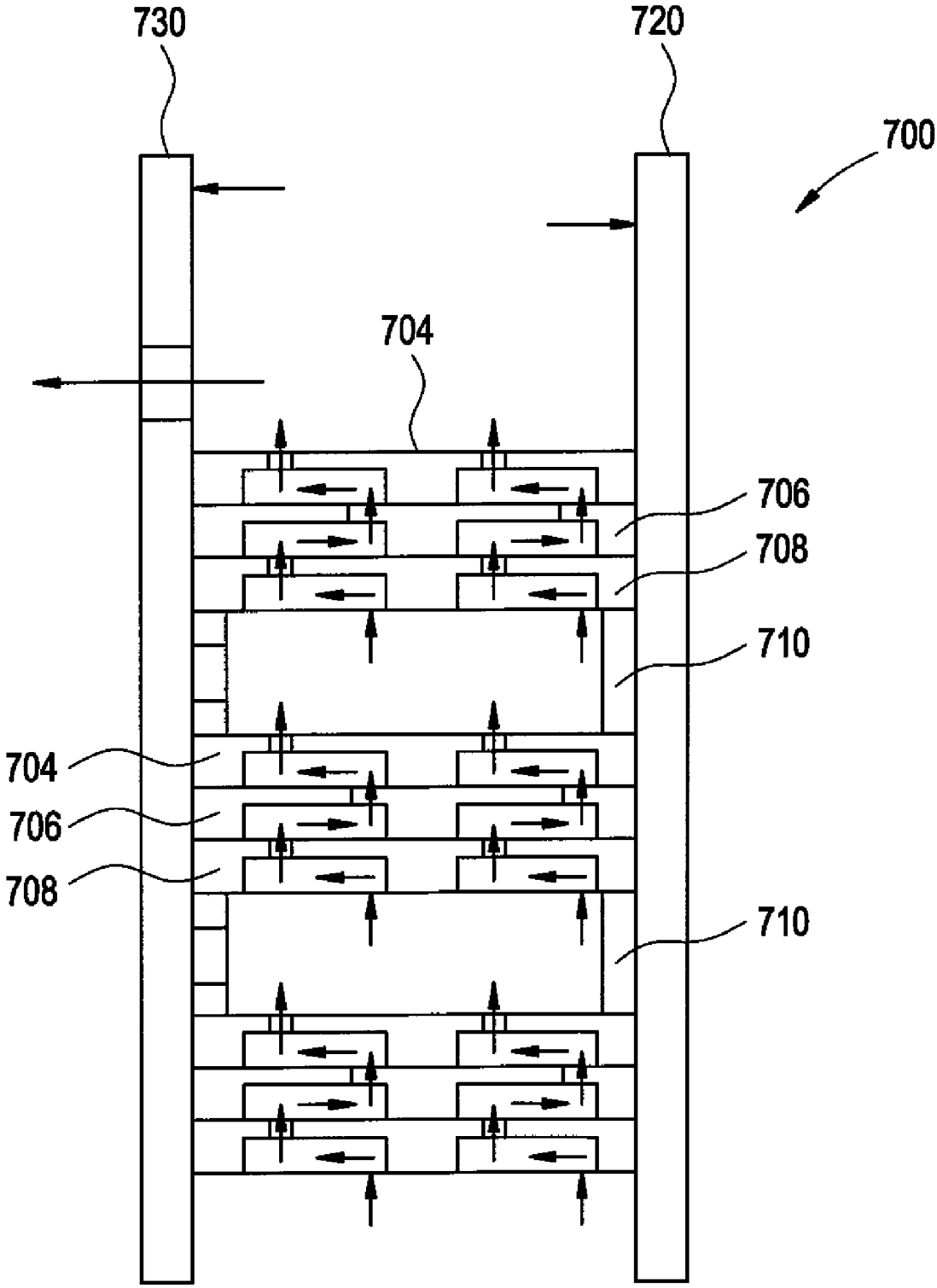
FIG. 18 is a cross-sectional schematic diagram of the spinner flow discs of FIGS. 15-17 installed in an inflow control device according to an embodiment of the invention.

FIG. 18 generally depicts a partial view 700 of an inflow control device using the spinner flow discs that are depicted in FIGS. 15-17 in accordance with some embodiments of the invention. As shown in FIG. 18, spinner flow discs 704, 706 and 708 may be annularly disposed between an inner mandrel 730 and an outer housing 720 and may be arranged in groups and set apart by spacers 710. The thickness of the spacers 710 and the number of adjacent spinner flow discs in each group, etc., may vary, depending on the particular embodiment of the invention to impart the desired flow characteristics.

Figure 19:
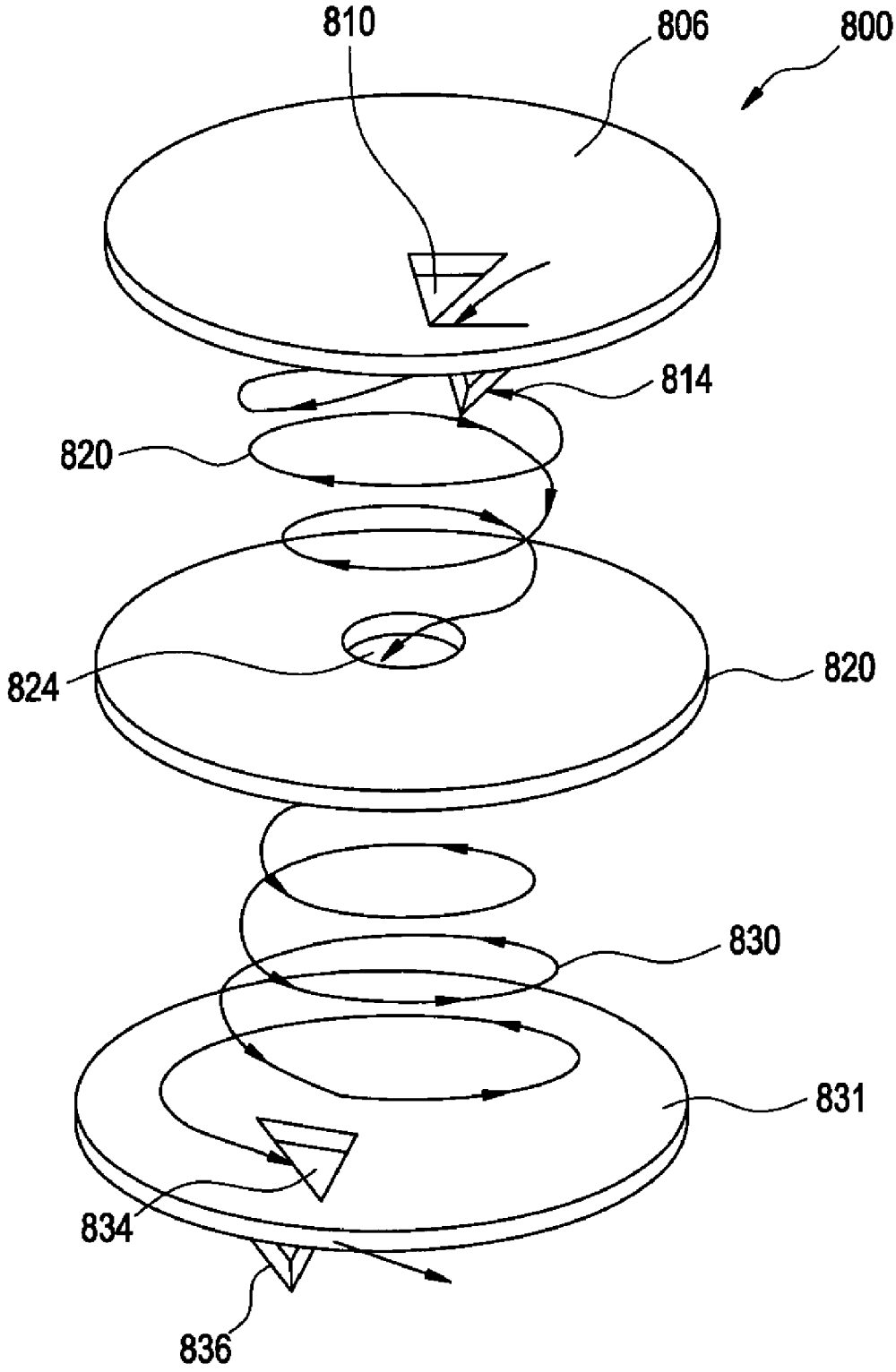
FIG. 19 is an illustration of an arrangement of axial spinner flow discs.

FIG. 19 depicts another variation in accordance with some embodiments of the invention. In particular, FIG. 19 is an illustration 800 of the use of axial spinner flow discs. In this arrangement, the flow discs create vortexes, which circulate in different directions to thereby impact momentum change (s). As a more specific example, the illustration 800 in FIG. 19 depicts a first axial spinner flow disc 806 that includes an exit port 810. The exit port 810 includes a tangential deflector 814, which establishes a corresponding clockwise flowing vortex 820. The vortex 820 is received by a central opening 824 of an acceleration disc 820 and exits the acceleration disc 820 having a reverse, counterclockwise flow in the form of a vortex 830. Fluid from the vortex 830 enters an exit port 834 of another spinner disc 831, which also has a tangential deflector 836 to create another vortex, which has the opposite momentum.

Figure 20:
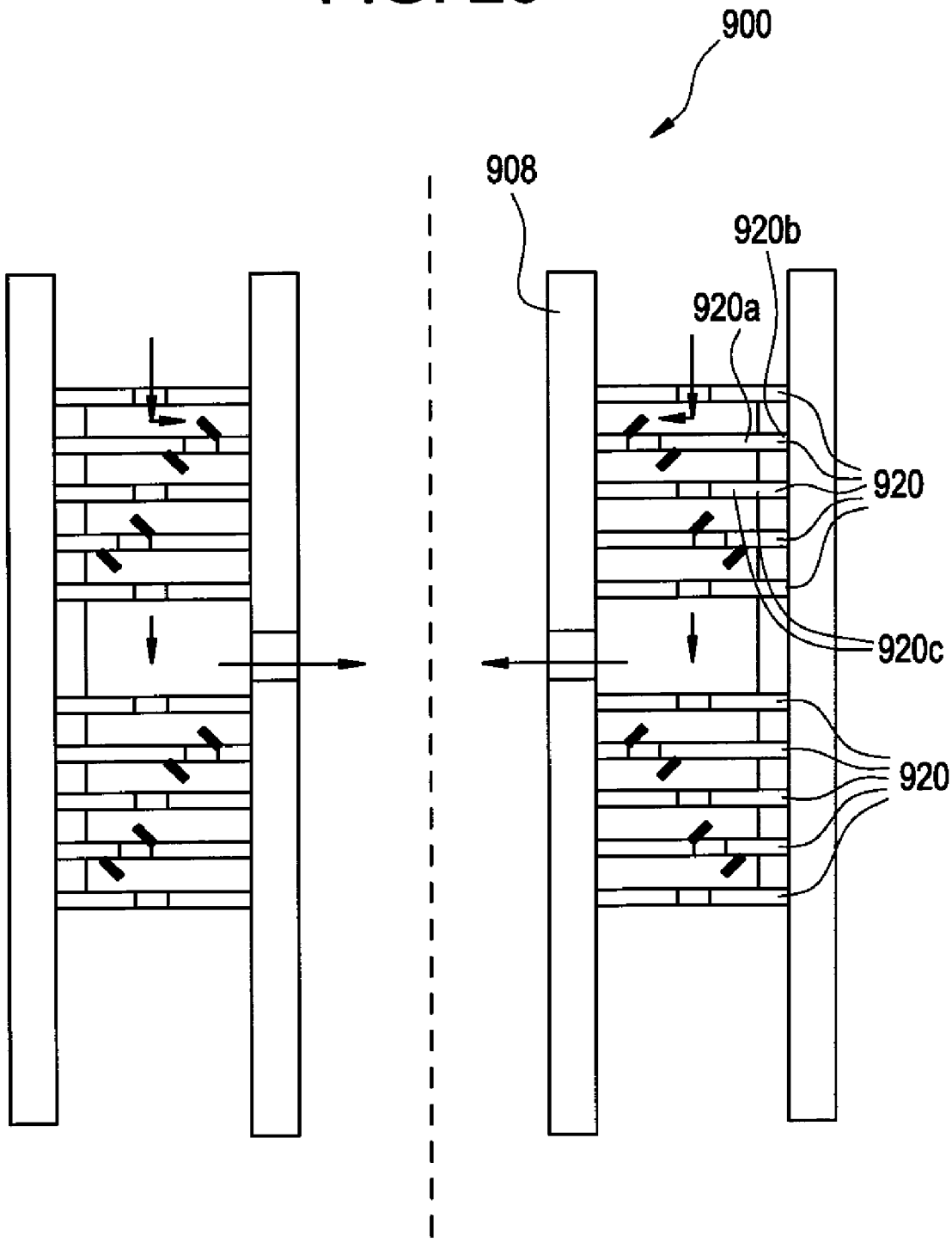
FIG. 20 is a cross-sectional schematic diagram of a section of an inflow control device that contains axial spinner flow discs according to an embodiment of the invention.

FIG. 20 depicts an arrangement 900 of axial spinner flow discs in accordance with embodiments of the invention. The spinner flow disc 900 may be disposed between an inner mandrel 908 and an outer housing 904. In general, the axial spinner flow discs are arranged in groups of three: a top 920*a*, an intermediate acceleration disc 920*b* and a bottom 920*c* axial spinner flow disc, consistent with the labeling used in connection with FIG. 19.

Figure 21:
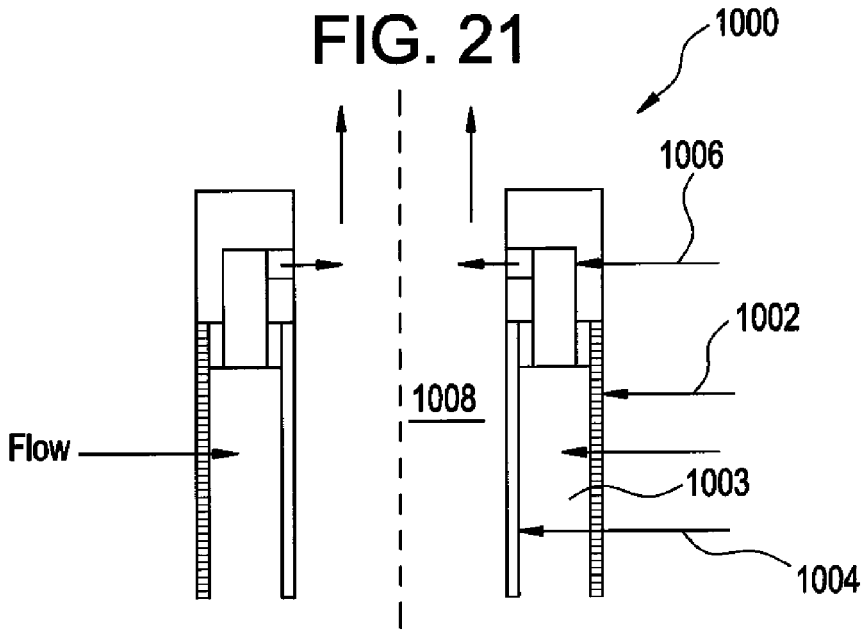
FIGS. 21-23 are schematic diagrams of inflow control devices according to different embodiments of the invention.

The inflow control devices may be used in an assembly that includes a sandscreen and may alternatively be used in assemblies that do not include sandscreens, depending on the particular embodiment of the invention. Thus, FIG. 21 depicts an assembly 1000, which is formed from an inflow control device 1006 (such as any of the inflow control devices disclosed herein), which controls communication of well fluid into a central passageway 1008 of a solid (i.e., non-perforated) base pipe 1004. An annular space 1003, which is located between a screen 1002 of the assembly 1000 and the outer surface of the basepipe 1004 receives well fluid. Communication of the well fluid between the annular space 1003 and the central passageway 1008 is controlled by the inflow control device 1006.

Figure 22:
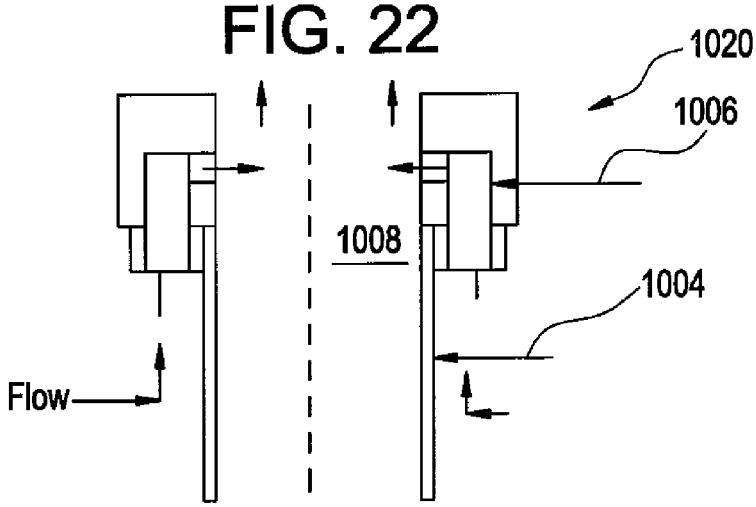

In accordance with other embodiments of the invention, an assembly 1020, which is depicted in FIG. 22 may be used. Similar to the assembly 1000, the assembly 1020 includes the inflow control device 1006 and the solid base pipe 1004. However, unlike the assembly 1000, the assembly 1020 does not include a surrounding flow control structure, such as the screen 1002.

Figure 23:
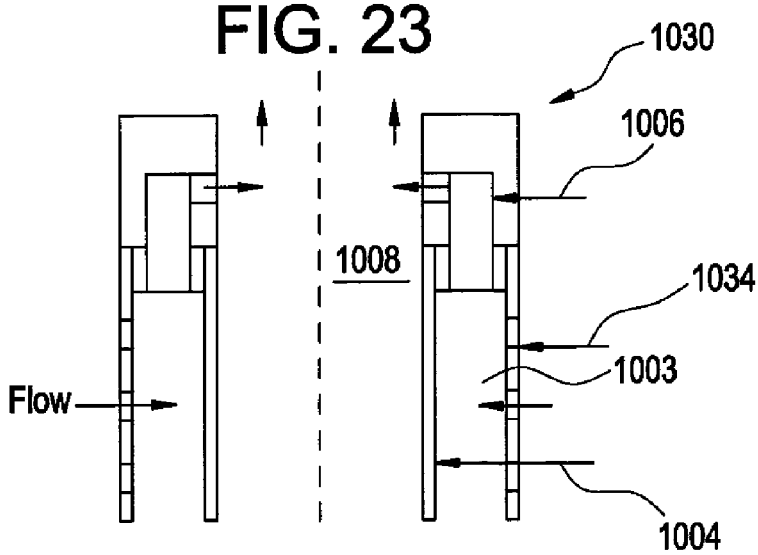

A flow control structure other than a screen may be used in accordance with other embodiments of the invention. In this regard, FIG. 23 depicts an assembly 1030, in accordance with other embodiments of the invention, which has a similar design to the assembly 1000, except that the screen 1002 of the assembly 1000 is replaced by a slotted or perforated pipe 1034 in the assembly 1030. Similar to the assembly 1000, the assembly 1030 includes the annular space 1003, which receives well fluid that is communicated through the openings of the pipe 1034. Communication from the annular space 1003 into the central passageway 1008 of the solid basepipe 1004 is controlled by the inflow control device 1006.

Figure 24:
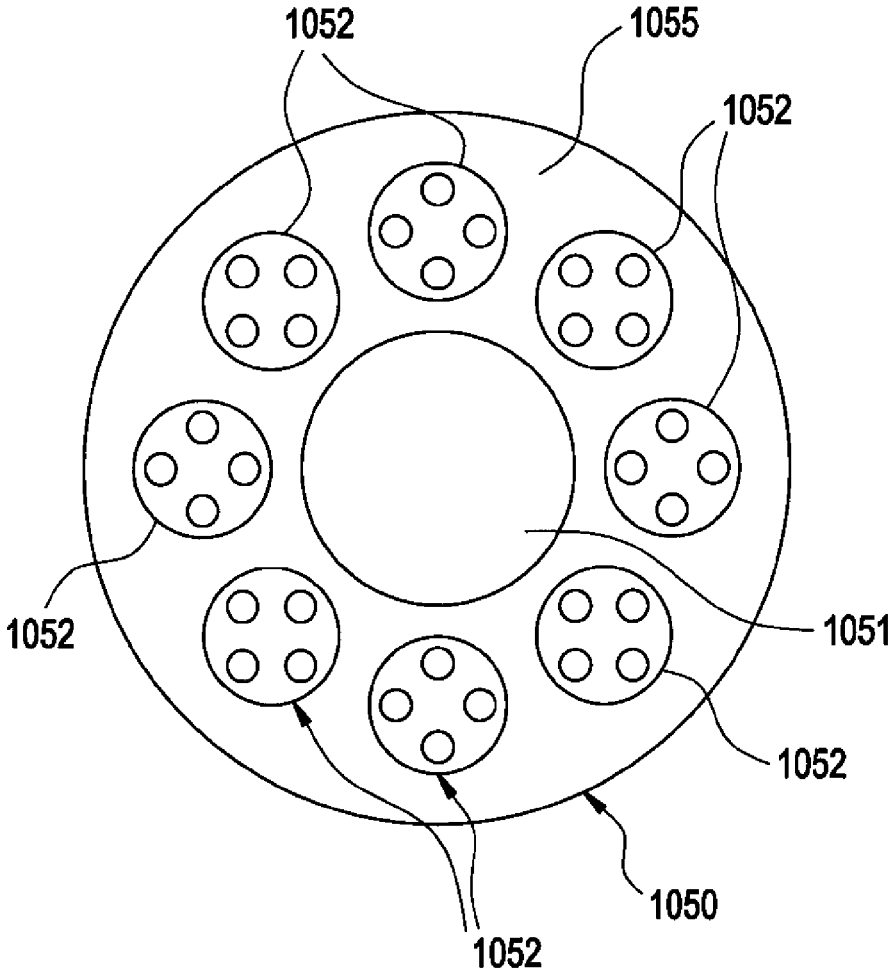
FIG. 24 is a top view of a flow restrictor that has spinner flow disc inserts according to an embodiment of the invention.
Figure 25:
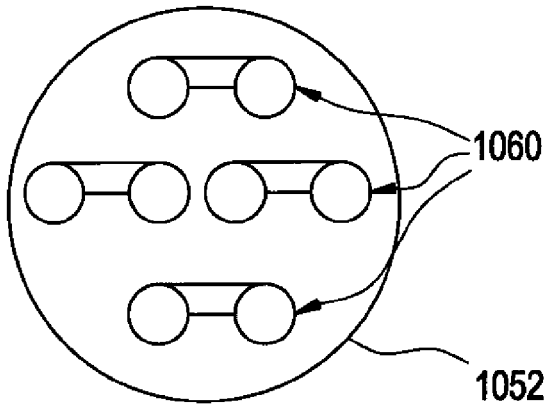
FIG. 25 is a more detailed view of a spinner flow disc of FIG. 24 according to an embodiment of the invention.

Other embodiments are contemplated and are within the scope of the appended claims. As an example, FIG. 24 depicts a flow restrictor 1050 in accordance with some embodiments of the invention. In general, the flow restrictor 1050 has a centralized opening 1051, which in general establishes communication through the flow restrictor 1050 through the central passageway of the basepipe. For purposes of controlling an incoming well fluid flow into the basepipe, the flow restrictor 1050 includes spinner flow discs 1052, which are disposed in an annular region 1055 that surrounds the central opening 1051. As depicted in a more detailed view in FIG. 25, each spinner flow disc 1052 includes multiple spin chambers 1060.

Figure 26:
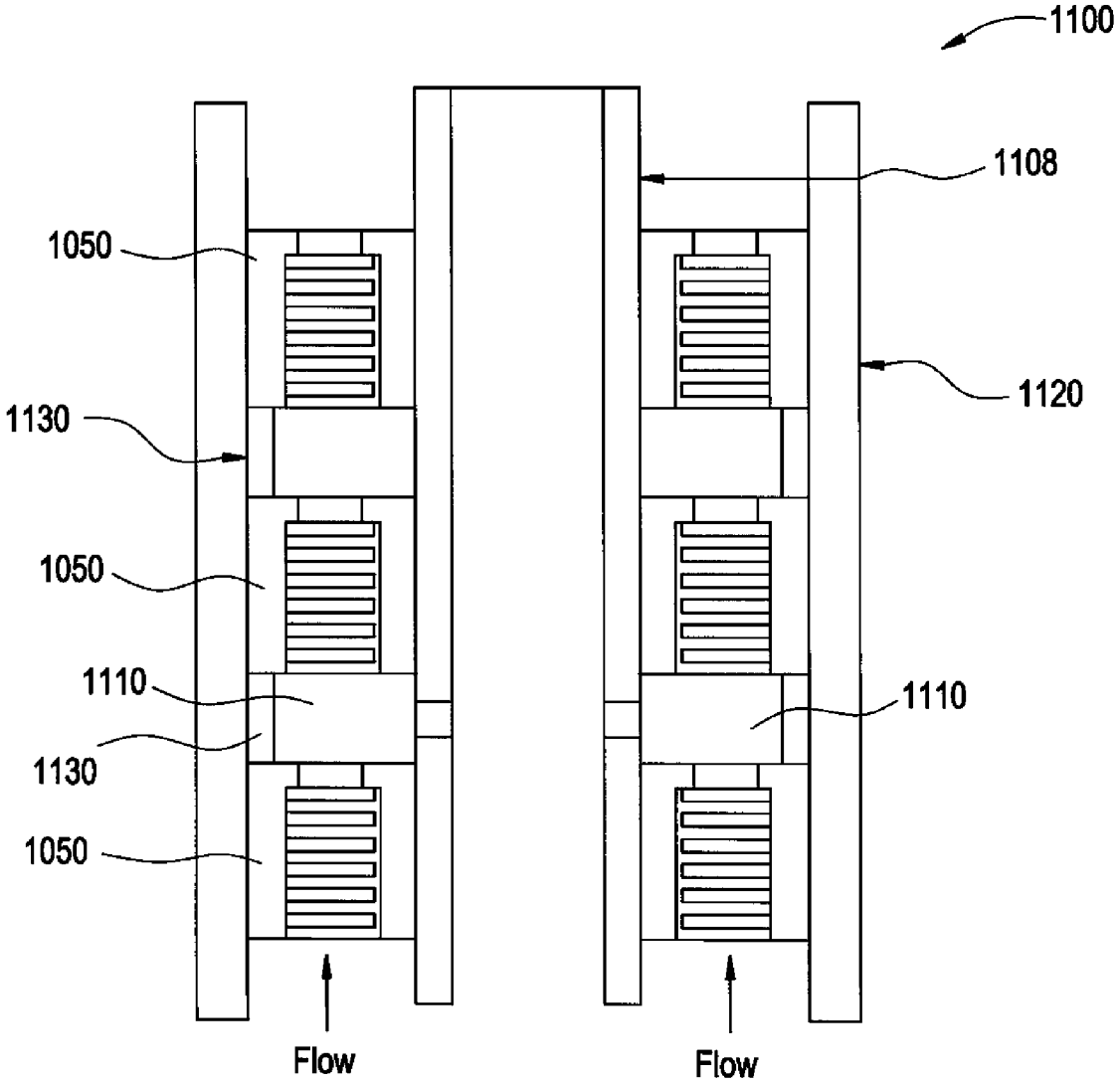
FIG. 26 is a schematic diagram of an inflow control device according to another embodiment of the invention.

Referring to FIG. 26, an inflow control device 1100 may be constructed using the flow restrictors 1050 in accordance with some embodiments of the invention. In general, an inner mandrel 1108 extends through the central openings 1051 (see FIG. 24) of a plurality of the flow restrictors 1050, which are stacked to form the flow restriction for the inflow control device 1100. More specifically, the flow restrictors 1050 may be separated by annular spacers 1130, as shown in FIG. 26. The flow restrictors 1050 are disposed between an outer housing 1120 of the inflow control device 1100 and the inner mandrel 1108.

The inner mandrel 1108 includes radial ports 1110 which control the number of momentum changes experienced by the incoming well fluid flow. Thus, as shown in FIG. 26, the axial, or longitudinal, position of the inner mandrel 1108 may be adjusted for purposes of controlling how many spin chambers 1060 (see FIG. 25) are traversed by the incoming well fluid flow.

Figure 27:
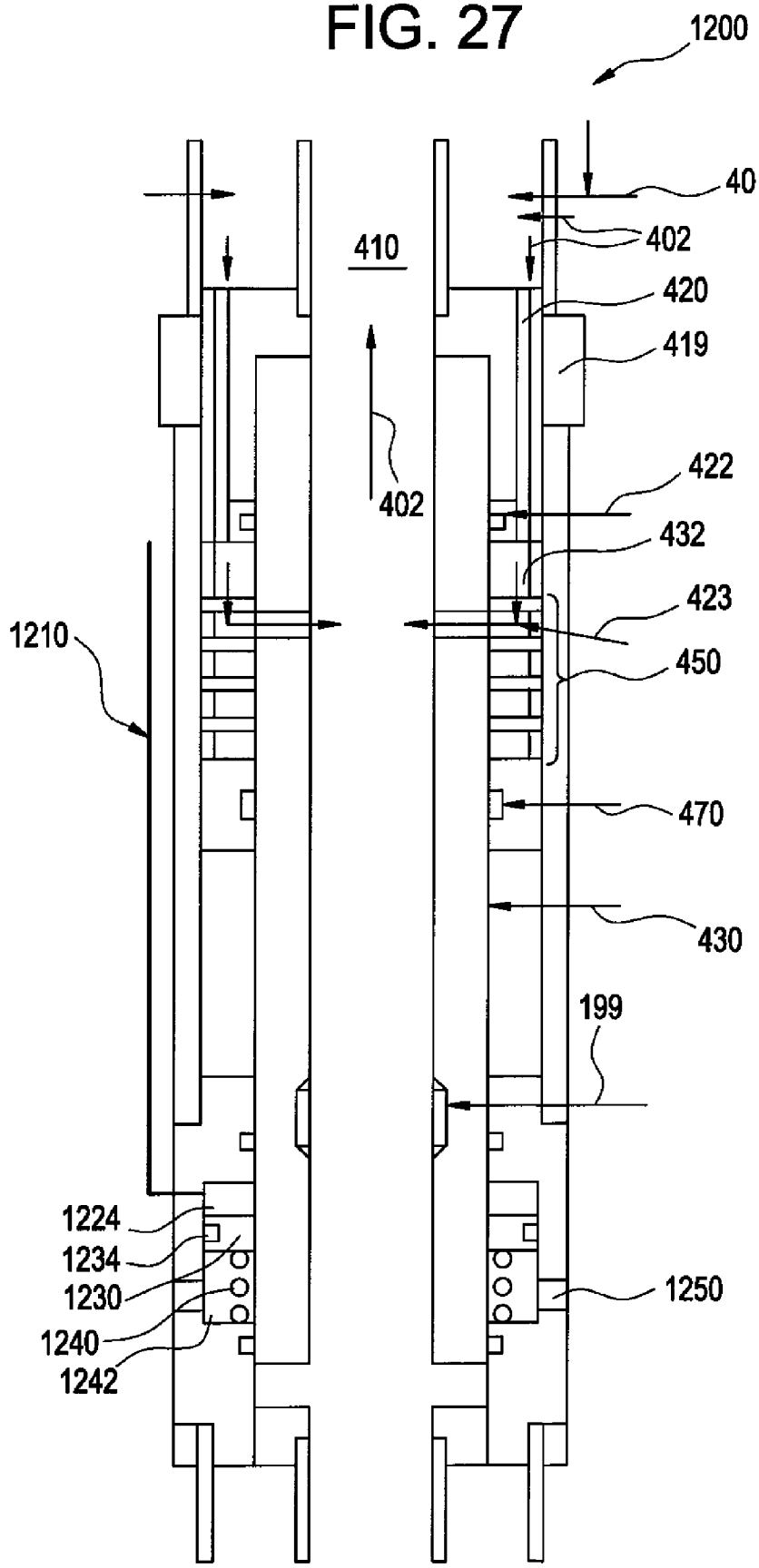
FIG. 27 is a schematic diagram of a surface-controlled inflow control device according to an embodiment of the invention.

As an example of another embodiment of the invention, FIG. 27 depicts a surface-controlled inflow control device 1200. Thus, unlike the inflow control devices disclosed above, the inflow control device 1200 does not require intervention (e.g., such as an intervention by a shifting tool). Instead, the inflow control device 1200 is controlled from the surface of the well via a control line 1210, which extends from the tool 1200 to the surface. The inflow control device 1200 has the same general design as the inflow control device 400 (see FIG. 6), with similar reference numerals being used to denote similar components. However, the inflow control device 1200 differs in how the inner mandrel 430 is controlled.

More specifically, unlike the inflow control device 400, the inflow control device 1200 includes a lower piston head 1230, which has an upper annular surface that is responsive to fluid pressure in an annular chamber 1224 (formed between the piston head 1230 and the housing 419). As depicted in FIG. 27, a fluid seal may be formed between the piston head 1230 and the housing 419 via an o-ring 1234, for example. The annular chamber 1224 is in communication with the control line 1210. The piston head 1230 has a lower annular surface that is in contact with a power spring 1240 (a coiled spring, for example), that resides in a lower chamber 1242 (a chamber formed between the piston head 1230 and the housing 419, for example). As depicted in FIG. 27, the chamber 1242 may be in fluid communication with the well annulus, in accordance with some embodiments of the invention.

Due to the arrangement of the piston head 1230 and chambers 1224 and 1242, the position of the inner mandrel 430 is controlled by the pressure that is exerted by the control line 1210. More specifically, by increasing the pressure exerted by the control line 1210, the inner mandrel 430 is moved downwardly to introduce the incoming well flow to more flow discs. Conversely, the inner mandrel 430 may be moved upwardly to reduce the number of flow discs, which are traversed by the incoming well flow, by decreasing the pressure that is exerted by the control line 1210. The pressure in the control line 1210 may be controlled by, for example, a fluid pump (not shown) that is located at the surface of the well.

As an example of yet another embodiment of the invention, the control line-related features of the inflow control device 1200 may be incorporated into a flow resistance-type inflow control device, such as the inflow control device 50 of FIGS. 3-5 (as an example). Thus, the flow resistance may be changed by controlling the pressure in a control line. Therefore, many variations are contemplated and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a well, comprising:

an inflow control device comprising discs adapted to form corresponding portions of an annular flow path; and a mechanism adapted to selectively change which discs are used to form the annular flow path to change a flow resistance of the annular flow path when the inflow control device is disposed downhole in the well from a first flow resistance to a different second flow resistance.

2. The apparatus of claim 1, wherein the annular flow path comprises a helical flow path.

3. The apparatus of claim 1, wherein the mechanism is adapted to change the flow resistance in response to being engaged by a shifting tool.

4. The apparatus of claim 1, further comprising:

a control line, wherein the mechanism is adapted to change the flow resistance in response to a pressure change in the control line.

5. A system usable with a well, comprising:

a tubular member having a well fluid communication passageway; and an inflow control device to change a momentum of a well fluid flow into the passageway to regulate a pressure of the well fluid flow, the inflow control device comprising a plurality of discs comprising multiple chambers to change the momentum of the well fluid flow multiple times.

6. The system of claim 5, wherein the inflow control device is adapted to subject the well fluid flow to at least two momentum changes.

7. The system of claim 5, further comprising:

a pipe to surround the tubular member, the pipe comprising openings to receive the well fluid flow in an annular space between the pipe and the tubular member.

8. The system of claim 5, further comprising:

a screen to surround the tubular member and receive the well fluid flow into an annular space between the screen and the tubular member.

9. The system of claim 5, wherein the tubular member comprises a production string.

10. The system of claim 5, further comprising:

a flow restrictor adapted to be disposed in the passageway and having an annular region to surround a centralized opening of the flow restrictor, wherein the discs are contained in the annular region.

11. The system of claim 5, wherein each of the multiple chambers establishes a flow path that substantially circumscribes a longitudinal axis of the inflow control device.

12. The system of claim 5, wherein each of the multiple chambers establishes a flow path that does not substantially circumscribe a longitudinal axis of the inflow control device.

13. The system of claim 5, wherein the discs are arranged to serially receive the well fluid flow, and each disc adapted to change the momentum of the well fluid flow.

14. The system of claim 13, wherein each disc has a single chamber associated with a single fluid channel.

15. The system of claim 13, wherein each disc has multiple chambers associated with multiple fluid channels.

16. The system of claim 13, wherein the discs establish axial flows.

17. The system of claim 5, wherein the inflow control device comprises an inflow momentum changing section, and the inflow control device is adapted to allow selection of at least three states:

a first state in which the flow bypasses the momentum changing section;

a second state in which the flow is communicated through the momentum changing section; and a third state in which the inflow control device blocks the flow.

18. An apparatus usable with a well, comprising:

an inflow control device comprising spinner discs to communicate a flow through the inflow control device; and a mechanism to allow a number of momentum changes experienced by the flow through the inflow control device to be changed downhole in the well.

19. The apparatus of claim 18, wherein inflow control device comprises a momentum changing section, and the inflow control device is adapted to allow selection of at least three states:

a first state in which the flow bypasses the momentum changing section;

a second state in which the flow is communicated through the momentum changing section; and a third state in which the flow control device blocks the flow.

20. The apparatus of claim 18, wherein each of the spinner discs comprises single flow channels.

21. The apparatus of claim 18, wherein each of the spinner discs comprises multiple flow channels.

22. The apparatus of claim 18, wherein the spinner discs comprise axial flow spinner discs.

23. The apparatus of claim 18, wherein the mechanism is adapted to be engaged by a shifting tool to change the number of momentum changes.

24. The apparatus of claim 18, further comprising:

a control line to establish communication between the mechanism and the surface of the well, wherein the mechanism is adapted to change the number of momentum changes in response to pressure exerted using the control line.

25. A method usable with a well, comprising:

communicating a flow through a sand screen and into an annular flow path of a flow control device downhole in the well;

changing a flow resistance of the annular flow path while the inflow control device is located downhole in the well; and causing the flow control device to transition to at least one of the following three states while downhole in the well:

a first state in which an inflow restrictor of the flow control device is bypassed by the flow;

a second state in which the flow is communicated through the inflow restrictor is changed; and a third state in which the flow control device blocks the flow.

26. The method of claim 25, further comprising:

communicating the flow through a sandscreen.

27. The method of claim 25, further comprising:

communicating the flow through openings in a pipe that surrounds a tubular member to which the inflow control device is mounted, 28. A method usable with a well, comprising:

communicating a flow through an inflow control device downhole in the well; and inside the inflow control device, changing a momentum of the flow, comprising communicating the flow through spinner discs.

29. The method of claim 28, further comprising:

communicating the flow through a sandscreen.

30. The method of claim 28, further comprising:

communicating the flow through openings in a pipe that surrounds a tubular member to which the inflow control device is mounted.

31. The method of claim 28, wherein the act of changing comprises:

subjecting the flow to at least two momentum changes inside the inflow control device.

32. A method usable with a well, comprising:

communicating a flow through an inflow control device downhole in the well; and changing a number of momentum changes experienced by the flow while the inflow control device is located downhole in the well, comprising changing comprises changing a number of spinner discs traversed by the flow.

33. An apparatus usable with a well, comprising:

an inflow control device having an annular flow path; and a mechanism adapted to change a flow resistance of the annular flow path when the inflow control device is disposed downhole in the well, wherein the mechanism is adapted to allow selection of at least three states for the inflow control device:

a first state in which an inflow restrictor of the inflow control device is bypassed by the flow;

a second state in which the flow is communicated through the inflow restrictor is changed; and a third state in which the inflow control device blocks the flow.

* * * * *